US009689229B2

(12) United States Patent
Hanson et al.

(10) Patent No.: US 9,689,229 B2
(45) Date of Patent: Jun. 27, 2017

(54) ROTATING MANDREL CASING HANGERS

(71) Applicant: Cameron International Corporation, Houston, TX (US)

(72) Inventors: Andrew R. Hanson, Cypress, TX (US); James D. Cavanagh, Cedar Park, TX (US); Michael F. Levert, Jr., Sugar Land, TX (US); Brandon B. Shirley, Singapore (SG); Kyle A. Sommerfeld, Houston, TX (US); Timothy W. Lim, Houston, TX (US); Adam J. Christopherson, Houston, TX (US)

(73) Assignee: Cameron International Corporation, Houston, TX (US)

( * ) Notice: Subject to any disclaimer, the term of this patent is extended or adjusted under 35 U.S.C. 154(b) by 612 days.

(21) Appl. No.: 13/867,947

(22) Filed: Apr. 22, 2013

(65) Prior Publication Data

US 2014/0311753 A1 Oct. 23, 2014

(51) Int. Cl.
*E21B 33/14* (2006.01)
*E21B 33/04* (2006.01)

(52) U.S. Cl.
CPC ..... *E21B 33/14* (2013.01); *E21B 33/0415* (2013.01)

(58) Field of Classification Search
CPC ..... E21B 33/05; E21B 33/04; E21B 33/0415; E21B 33/14
See application file for complete search history.

(56) References Cited

U.S. PATENT DOCUMENTS

| | | | | |
|---|---|---|---|---|
| 3,918,747 | A | 11/1975 | Putch | |
| 4,154,298 | A | 5/1979 | Gano | |
| 4,171,018 | A | 10/1979 | Walker | |
| 4,497,371 | A | 2/1985 | Lindsey | |
| 4,674,576 | A | 6/1987 | Goris et al. | |
| 5,105,888 | A | 4/1992 | Pollock et al. | |
| 5,498,043 | A | 3/1996 | Goldenberg | |
| 5,579,829 | A | 12/1996 | Comeau et al. | |
| 5,607,019 | A | 3/1997 | Kent | |
| 7,213,655 | B2 | 5/2007 | Parrott | |
| 7,377,337 | B2 * | 5/2008 | Swietlik | E21B 4/006 175/101 |
| 8,528,650 | B1 | 9/2013 | Smith et al. | |
| 2002/0121367 | A1 * | 9/2002 | Meek | E21B 43/127 166/78.1 |
| 2004/0149431 | A1 * | 8/2004 | Wylie | C09K 8/12 166/242.1 |
| 2010/0326674 | A1 | 12/2010 | Nguyen et al. | |
| 2012/0305269 | A1 | 12/2012 | Bories et al. | |
| 2013/0319688 | A1 * | 12/2013 | Moellendick | E21B 33/0415 166/382 |
| 2015/0041151 | A1 * | 2/2015 | Cocker, III | E21B 33/14 166/380 |

* cited by examiner

*Primary Examiner* — David Andrews
(74) *Attorney, Agent, or Firm* — Eubanks PLLC

(57) ABSTRACT

Rotating mandrel casing hangers are provided. In one embodiment, a system includes a casing hanger having a lower end configured to engage a casing string and a running tool configured to engage the casing hanger. The system is configured to facilitate rotation of the casing hanger within a casing head to rotate the casing string while cementing the casing string within a well. Additional systems, devices, and methods are also disclosed.

12 Claims, 21 Drawing Sheets

ROTATING MANDREL CASING HANGERS

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in finding and extracting oil, natural gas, and other subterranean resources from the earth. Particularly, once a desired subterranean resource such as oil or natural gas is discovered, drilling and production systems are often employed to access and extract the resource. These systems may be located onshore or offshore depending on the location of a desired resource. Further, such systems generally include a wellhead assembly mounted on a well through which the resource is accessed or extracted. These wellhead assemblies may include a wide variety of components, such as various casings, valves, pumps, fluid conduits, and the like, that control drilling or extraction operations.

As will be appreciated, wells are often lined with casing that generally serves to stabilize the well and to isolate fluids within the wellbore from certain formations penetrated by the well (e.g., to prevent contamination of freshwater reservoirs). Such casing is frequently cemented into place within the well. During a cement job, cement can be pumped down a casing string in a well, out the bottom of the casing string, and then up the annular space surrounding the casing string. The cement is then allowed to set in the annular space.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Embodiments of the present disclosure generally relate to mandrel casing hangers for rotating casing strings during cementing of the casing strings in wells. Such rotation may reduce undesirable cavities or fissures in the cement. In various embodiments, running tools are provided for engaging the casing hangers. The running tools can be used to rotate the casing hangers and their connected casing strings during cementing of the casing strings. In some embodiments, the casing hangers are supported in whole or in part by a casing head during rotation, while in others the casing hangers are lifted off a landing shoulder and supported in some other way, such as by a top drive. Various techniques for connecting running tools to casing hangers and for facilitating rotation of casing hangers with their casing strings are also provided.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
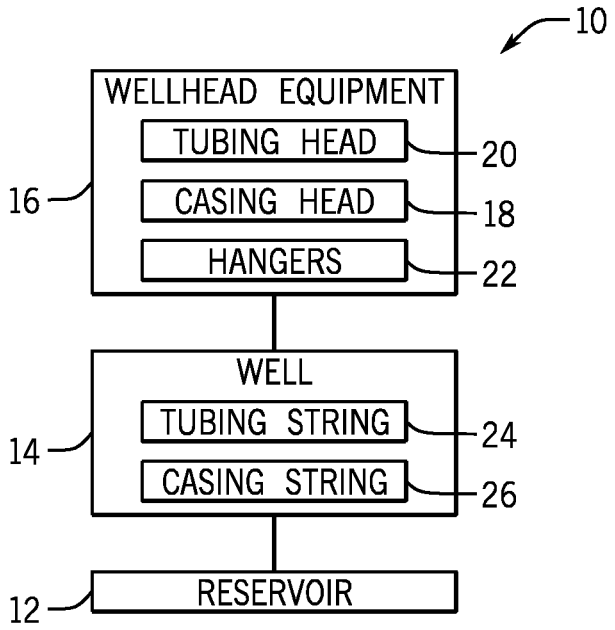
FIG. 1 generally depicts various components, including one or more casing strings and associated hangers, that can be installed at a well in accordance with one embodiment of the present disclosure.

Turning now to the present figures, a system 10 is illustrated in FIG. 1 in accordance with one embodiment. Notably, the system 10 is a production system that facilitates extraction of a resource, such as oil, from a reservoir 12 through a well 14. Wellhead equipment 16 is installed on the well 14. As depicted, the wellhead equipment 16 includes at least one casing head 18 and tubing head 20, as well as hangers 22. But the components of the wellhead equipment 16 can differ between applications, and could include a variety of casing heads, tubing heads, hangers, stuffing boxes, pumping tees, and pressure gauges, to name only a few possibilities.

The hangers 22 can be positioned within the tubing and casing heads, and each of the hangers 22 can be connected to a tubing string 24 or a casing string 26 to suspend such strings within the well 14. The well 14 can include a single casing string 26 or include multiple casing strings 26 of different diameters. Casing strings 26 are often cemented in place within the well. During a cement job, cement is typically pumped down the casing string. A plug is then pumped down the casing string with a displacement fluid (e.g., drilling mud) to cause the cement to flow out of the bottom of the casing string and up the annular space around the casing string. Moving the casing string during cementing can increase uniformity of the cement about the casing string and reduce the size or frequency of undesirable cavities or fissures in the cement. Accordingly, various embodiments of the present disclosure include mandrel hangers (in contrast to slip-type hangers) that can be coupled to casing strings and used to rotate the casing strings during cementing.

Moreover, in the various embodiments described below, casing hangers can be attached to casing strings and can be rotated on a landing shoulder or lifted off of a landing shoulder during rotation. Indeed, to facilitate rotation, in some embodiments an upward force can be applied to the casing hanger to reduce the amount of loading by the casing hanger on a landing shoulder without lifting the casing hanger off of the shoulder. Any suitable devices or machines may be used to rotate the casing hanger or apply an upward force to the casing hanger. For example, in some embodiments, a top drive can be used to both rotate and support some or all of the weight of the casing hanger and its connected casing string.

Figure 2:
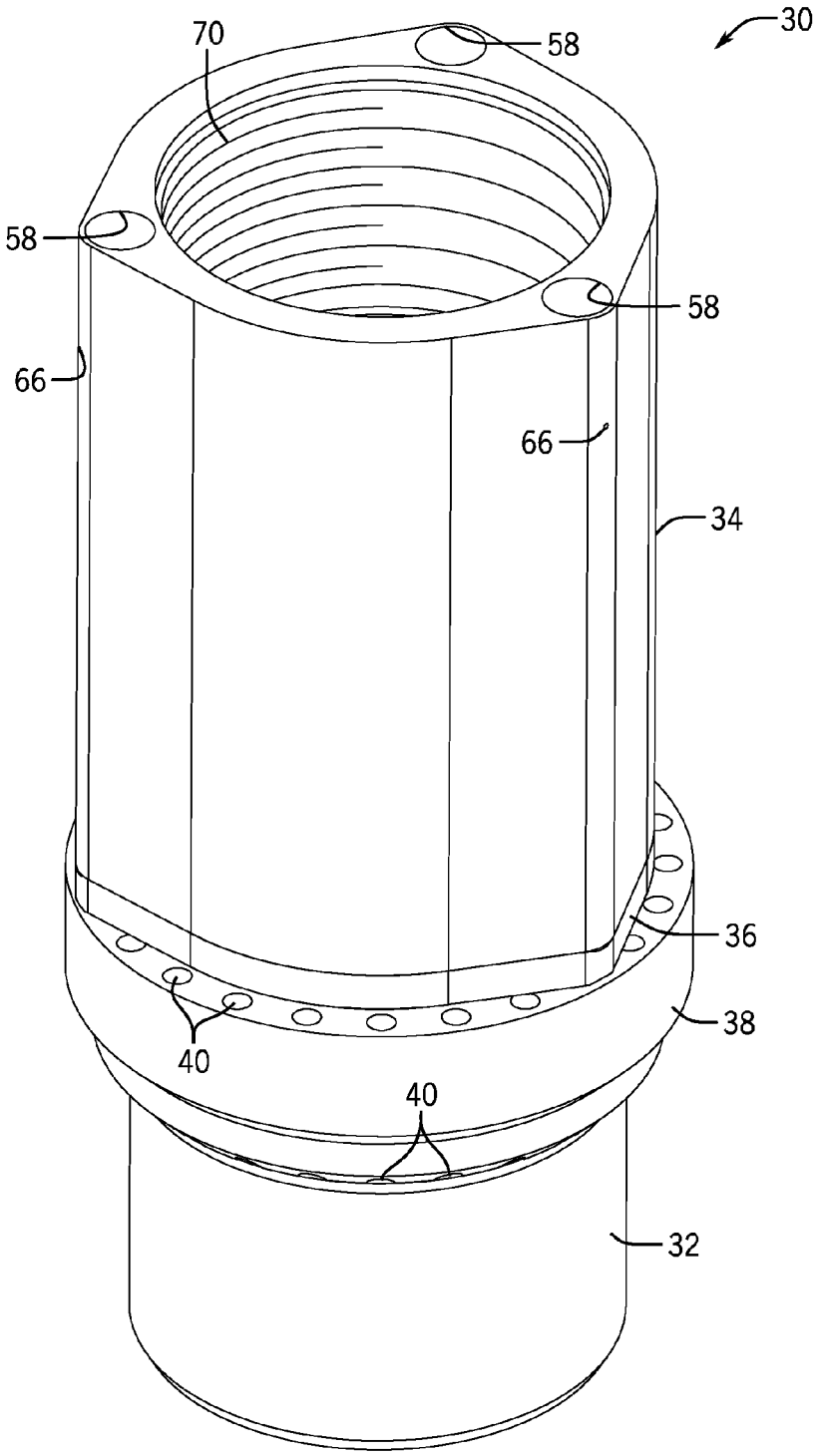
FIG. 2 is a perspective view of a casing hanger assembly including a casing hanger and a running tool in accordance with one embodiment.
Figure 3:
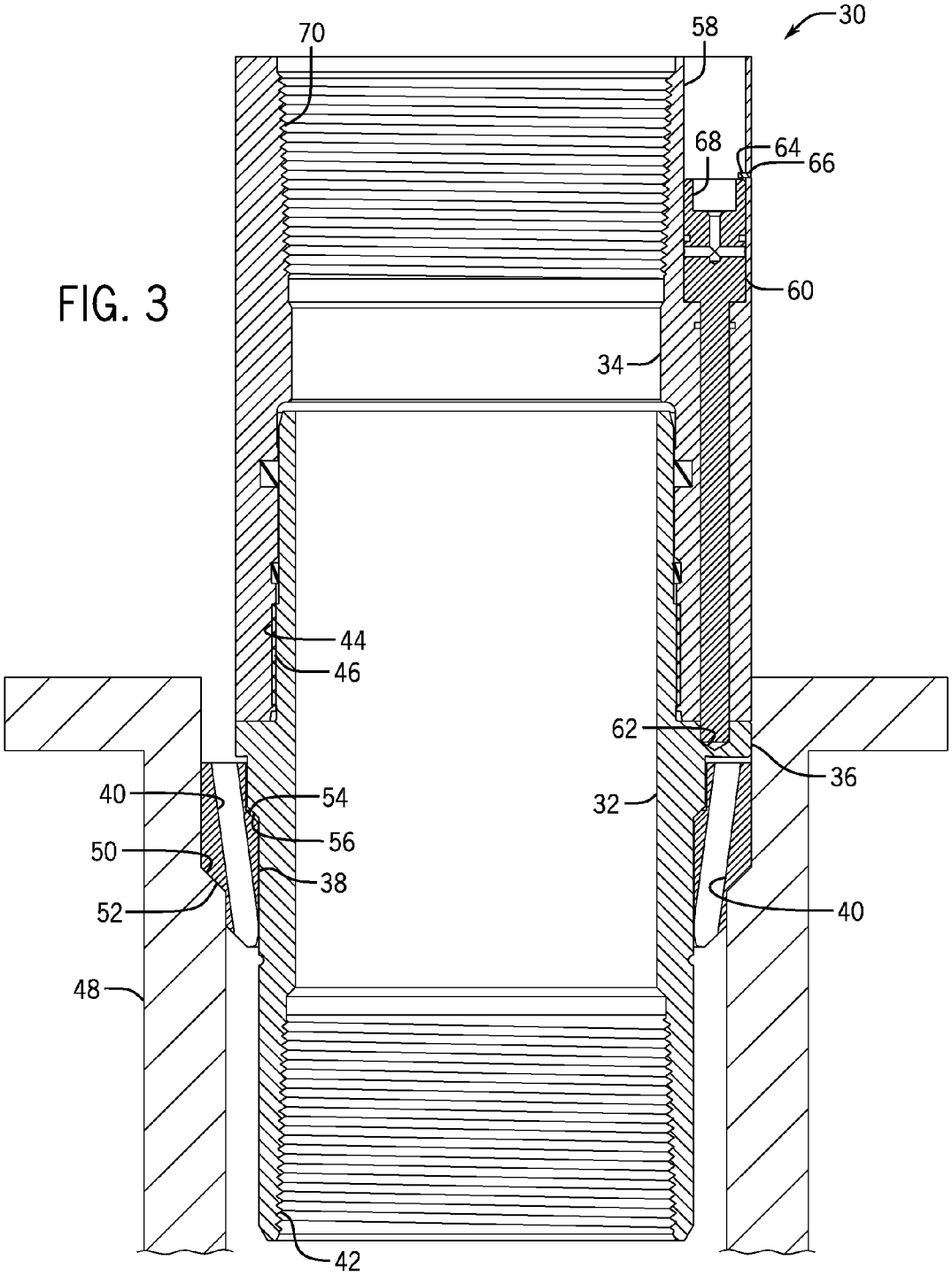
FIG. 3 is a cross-section showing the casing hanger assembly of FIG. 2 in a casing head in accordance with one embodiment.

One example of a casing hanger assembly 30 is depicted in FIGS. 2 and 3. In this embodiment, the assembly 30 includes a mandrel casing hanger 32 and a running tool 34. The casing hanger 32 includes a flange 36 and is installed within a removable landing ring 38. The landing ring 38 includes flow-by ports 40 that allow fluid to pass through the landing ring 38. The casing hanger 32 can include various threaded surfaces for connection to other components. For instance, as depicted, the casing hanger 32 includes a threaded end 42 for receiving a threaded casing joint, which allows a casing string to be suspended from the casing hanger 32 via the threaded end 42. The casing hanger 32 also includes a threaded surface 44 that engages a mating threaded surface 46 of the running tool 34.

The assembly 30 is shown installed within a casing head 48 in FIG. 3. More specifically, the casing head 48 includes a tapered shoulder 50 that engages a mating external shoulder 52 of the landing ring 38. The landing ring 38 also includes an internal tapered shoulder 54 that receives a mating shoulder 56 of the casing hanger 32. Thus, once installed, the casing hanger 32 rests on the landing ring 38, which rests on the shoulder 50 of the casing head 48.

In the present embodiment, the running tool 34 includes through holes 58 having locking pins 60. The running tool 34 can be threaded onto the casing hanger and the pins 60 may be extended into corresponding recesses 62 in the flange 36 to lock the running tool 34 to the casing hanger 32. When connected in this manner, torque on the running tool 34 (e.g., applied during cementing of a casing string suspended from the casing hanger 32) can be transmitted to the casing hanger 32 via the pins 60 such that the running tool 34, the casing hanger 32, and a casing string suspended from the casing hanger 32 all rotate synchronously. The pins 60 may then be retracted from the recesses 62 and the running tool 34 can be unthreaded from the casing hanger 32 for removal. Shear pins 64 can be installed in holes 66 of the running tool 34 to retain the pins 60 in their extended positions (i.e., engaging the recesses 62). In the instant embodiment, hydraulic fluid can be pumped into the pins 60 via ports 68 to break the shear pins 64 and retract the pins 60 from the recesses 62. The depicted running tool 34 includes a threaded upper end 70 so that the running tool 34 can be threaded onto another component (e.g., a casing joint) that drives rotation of the running tool 34, the casing hanger 32, and a connected casing string. But the depicted assembly 30 can be rotated in any suitable manner.

Figure 4:
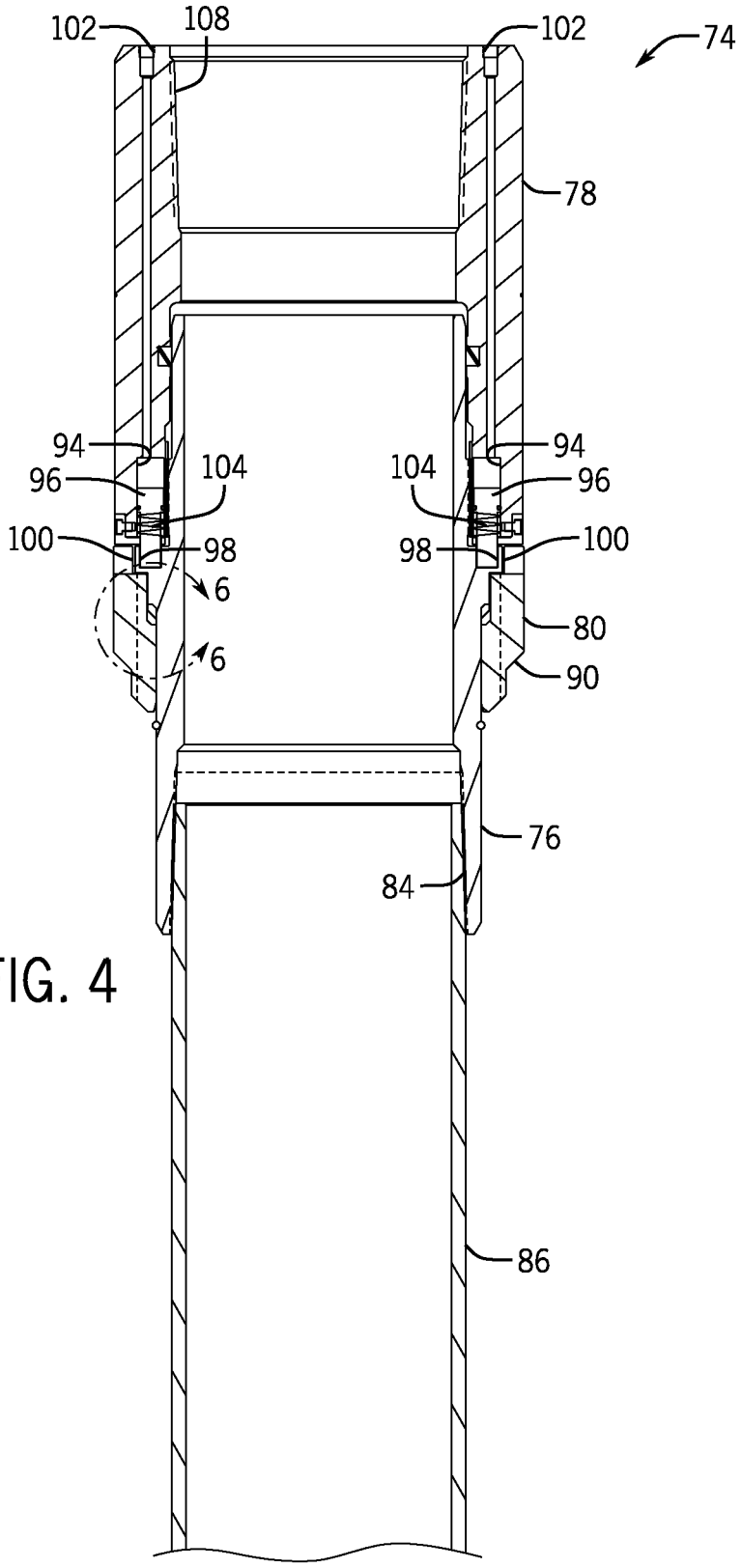
FIGS. 4 and 5 are cross-sections generally depicting certain features of a casing hanger assembly having hydraulically actuated locking pins for securing a running tool to a casing hanger in accordance with certain embodiments.
Figure 5:
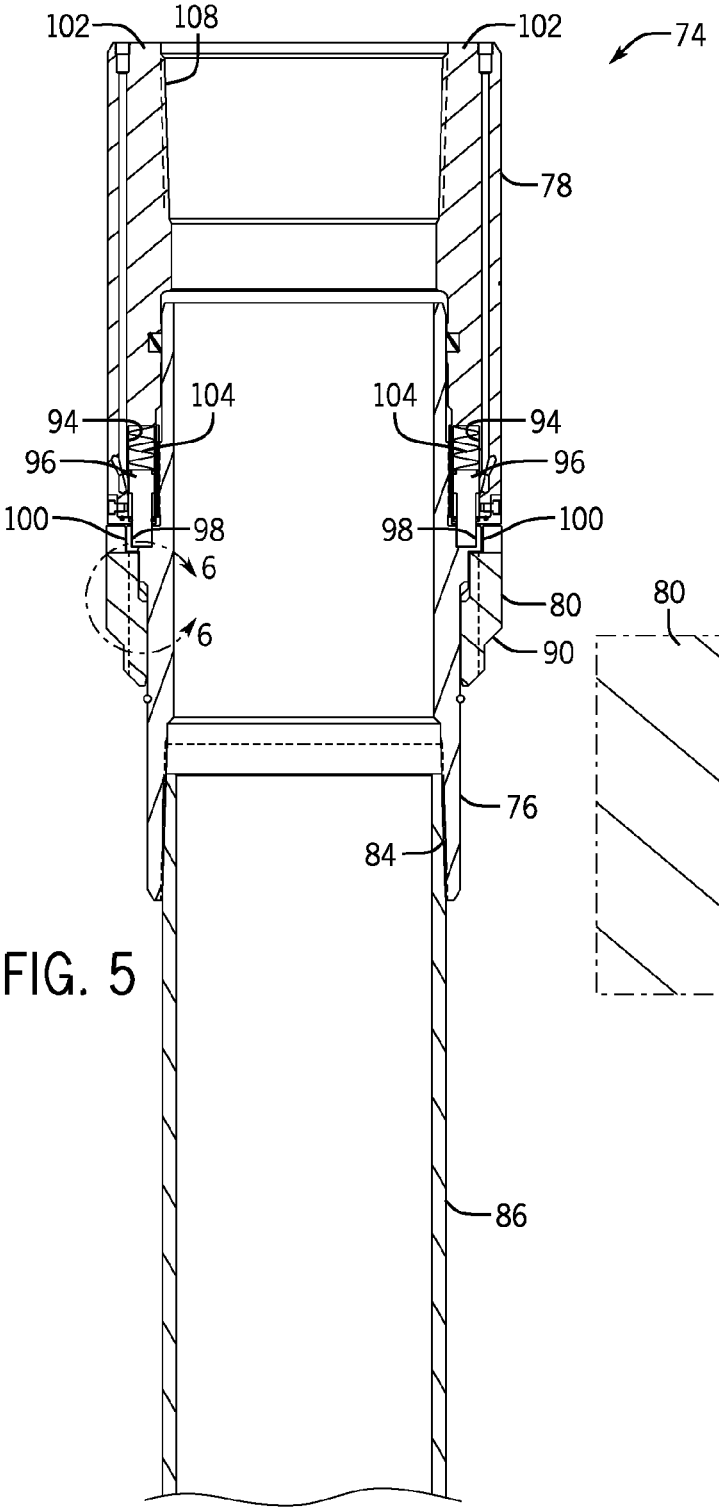
Figure 6:
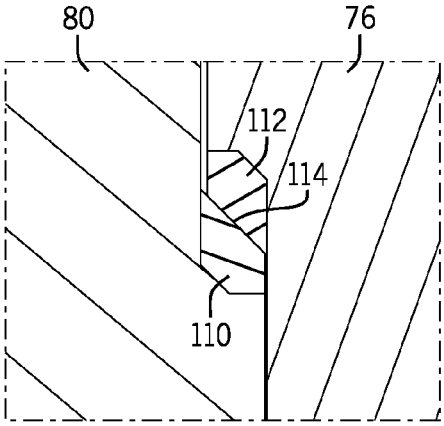
FIG. 6 is a detail view of FIGS. 4 and 5, and illustrate the inclusion of gall-resistant rings to facilitate rotation of the casing hanger on a shoulder of a landing ring.

A casing hanger assembly 74 is depicted in FIGS. 4-6 in accordance with another embodiment. Like the assembly 30 described above, the assembly 74 includes a mandrel casing hanger 76, a running tool 78, and a landing ring 80. The casing hanger 76 includes a threaded end 84 for receiving a casing string 86. The casing hanger 76 is received within the landing ring 80, which includes a shoulder 90 for engaging a complimentary shoulder of a casing head (e.g., shoulder 50 of casing head 48). The running tool 78 can be threaded onto the casing hanger 76 in a manner similar to that described above with respect to the assembly 30. The assembly 74 also includes locking pins 96 in recesses 94 of the running tool 78. These pins 96 can be extended into recesses 98 (here provided in a flange 100 of the casing hanger 76) to lock the running tool 78 to the casing hanger 76. Like above, torque on the running tool 78 can be transmitted to the casing hanger 76 via the pins 96 so that the running tool 78, the casing hanger 76, and the casing string 86 rotate together (e.g., during cementing of the casing string 86 within a well).

As depicted in FIGS. 4 and 5, the locking pins 96 are controlled through the application of pressurized fluid (hydraulic or pneumatic) into ports 102 of the running tool 78 and are spring-biased toward either their retracted positions or their extended positions. Particularly, in FIG. 4, springs 104 are provided about the pins 96 to bias them toward their retracted positions. Sufficient pressure applied to the ports 102 in FIG. 4 can overcome the biasing forces of the springs 104 and cause the pins 96 to extend into the recesses 98. Conversely, in FIG. 5 the springs 104 are provided behind the pins 96 to bias them toward their extended positions and pressure may be applied via the ports 102 to retract the pins 96 and disengage the recesses 98. As generally noted above, the running tool 78 can be rotated in any suitable manner, such as by connection to its threaded end 108.

To reduce galling between a casing hanger and a landing shoulder, one or more gall-resistant rings or surface coatings can be provided. For example, as generally depicted in FIG. 6, gall-resistant rings 110 and 112 are provided between the casing hanger 76 and the landing ring 80. The two gall-resistant rings 110 and 112 can be formed of any suitable materials, such as gall-resistant stainless steels, and have a tapered interface 114. The use of one or more such gall-resistant rings can inhibit galling between a casing hanger and a landing shoulder and reduce wear on such components from rotation of the casing hanger within a casing head.

Figure 7:
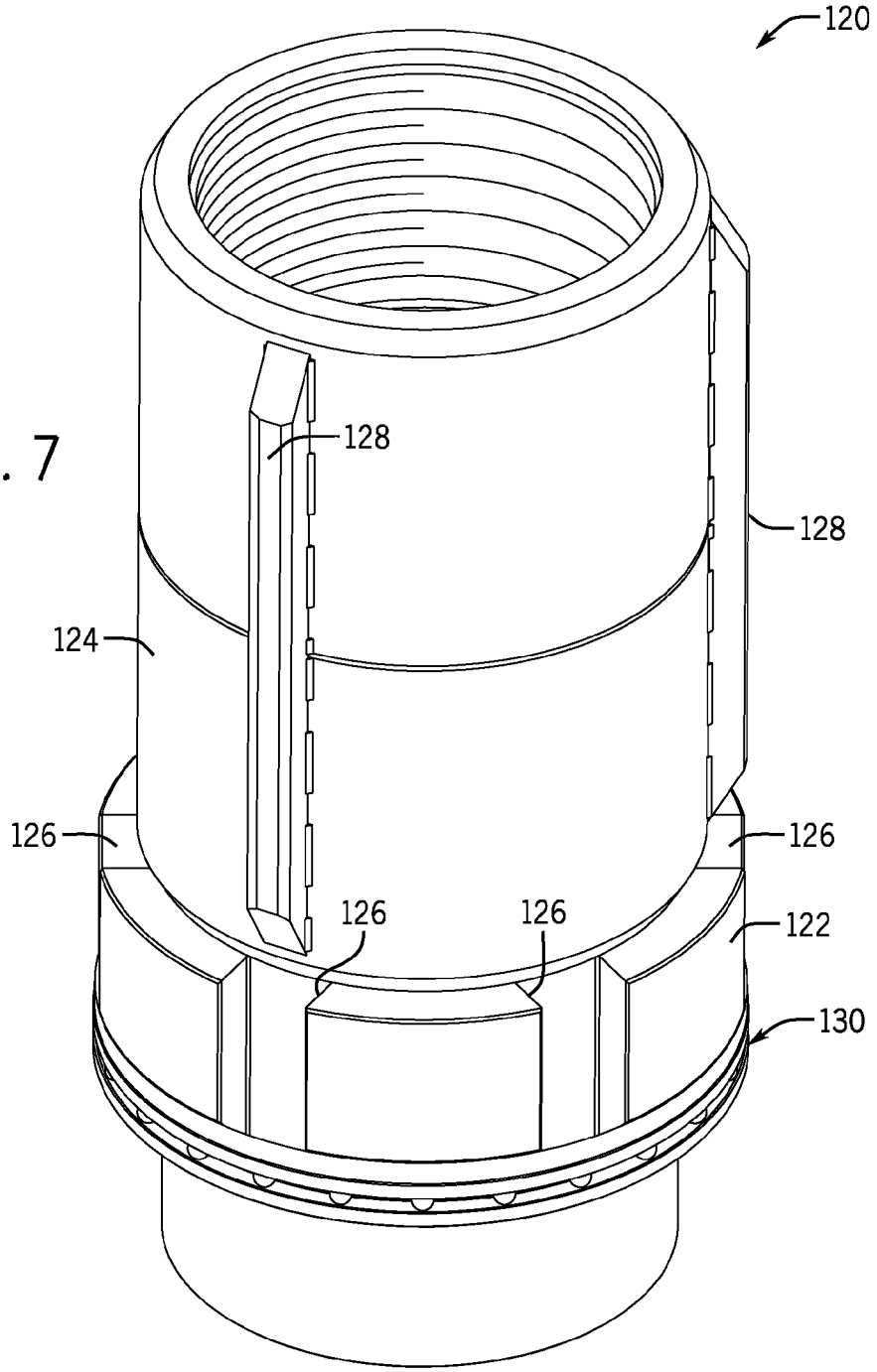
FIG. 7 is a perspective view of a casing hanger assembly with a running tool installed on a casing hanger and a mechanical bearing in accordance with one embodiment.
Figure 9:
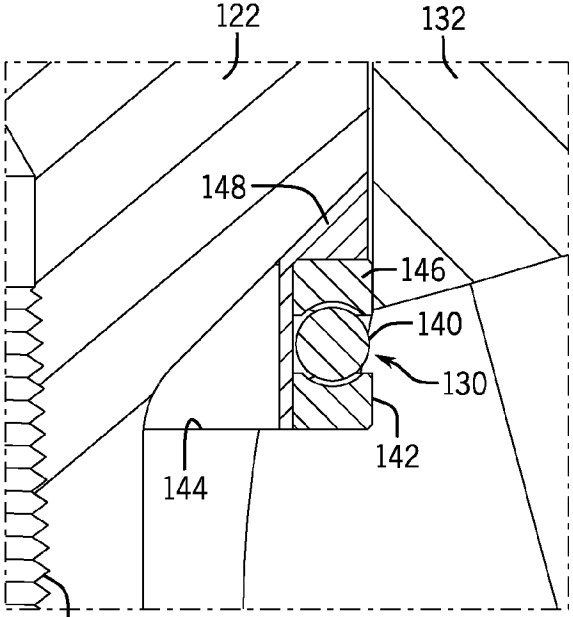
FIG. 9 is a detail view of the mechanical bearing of FIGS. 7 and 8, which facilitates rotation of the casing hanger with respect to the casing head.
Figure 8:
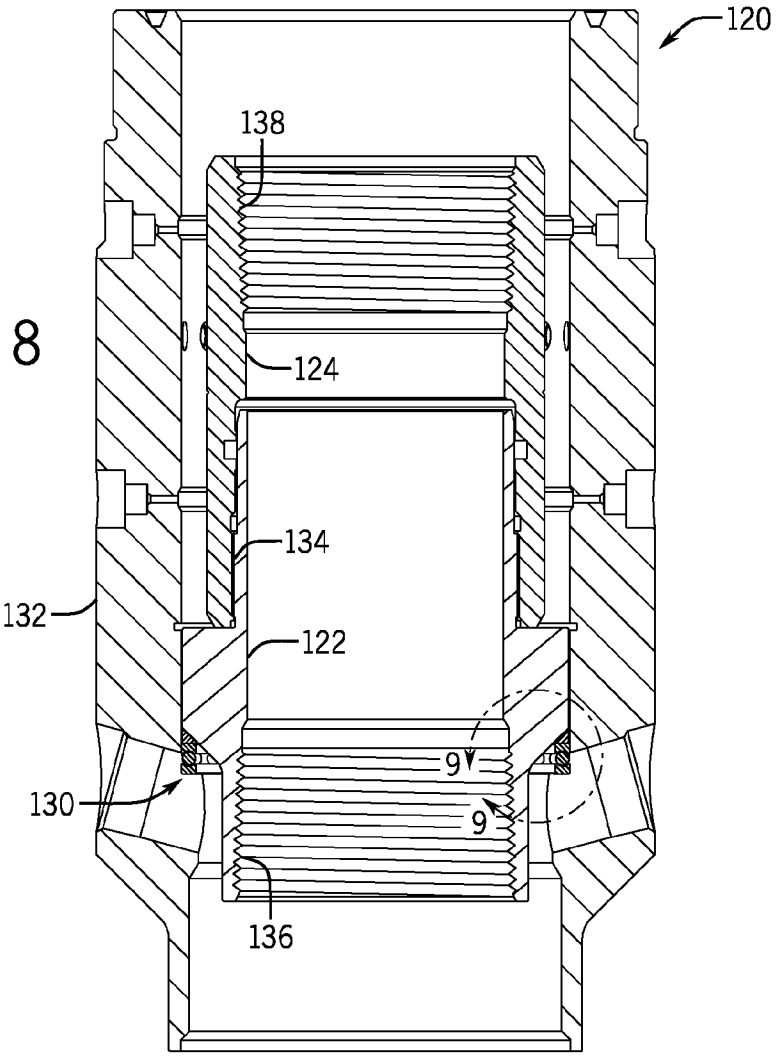
FIG. 8 is a cross-section of the casing hanger assembly of FIG. 7 installed in a casing head in accordance with one embodiment.

In another embodiment generally depicted in FIGS. 7-9, a casing hanger assembly 120 includes a mandrel casing hanger 122 and a running tool 124 having external ribs 128. The casing hanger 122 includes an integral landing ring with flow-by channels or paths 126 that facilitate fluid flow about the assembly 120 when installed in a casing head. The assembly 120 also includes a bearing 130 that facilitates rotation of the casing hanger 122 within a casing head 132, as depicted in FIG. 8. In this figure, the running tool 124 is threaded onto the casing hanger 122 via a threaded interface 134 so that rotation of the running tool 124 causes synchronous rotation of the casing hanger 122. The assembly 120 may also include other threaded surfaces. For example, the assembly 120 is illustrated as including a threaded surface 136 for joining a casing string to the casing hanger 122 and a threaded surface 138 for connecting the running tool 124 to a rotatable component (such as a casing joint) to drive rotation of the running tool 124, the casing hanger 122, and the casing string.

As shown in the detail view of FIG. 9, the bearing 130 includes roller elements 140 (e.g., ball bearings) disposed between a lower race 142 and an upper race 146. The casing head 132 includes a shoulder 144 for receiving the bearing 130. A shoulder ring 148 is positioned between a shoulder of the casing hanger 122 and the upper race 146, such that the casing hanger 122 rests on the shoulder ring 148. During rotation of the casing hanger 122, the roller elements 140 facilitate rotation of the casing hanger 122 (along with the upper race 146 and the shoulder ring 148) with respect to the casing head 132. In the depicted embodiment, the shoulder ring 148 includes a tab portion positioned along and radially inward with respect to the lower and upper races 142 and 146 so as to inhibit contamination of the bearing 130 by fluids within the bore of the casing head 132.

Figure 10:
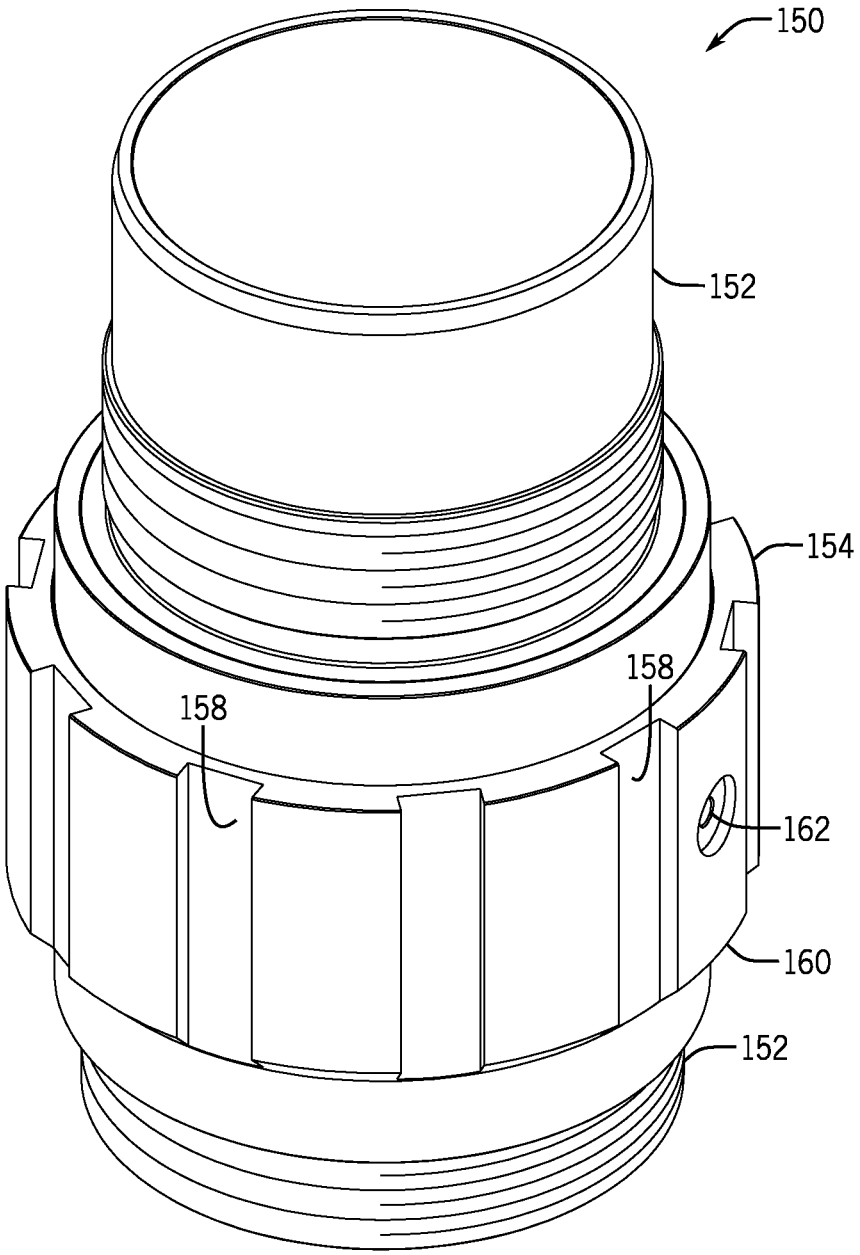
FIG. 10 is a perspective view of a casing hanger assembly having a fluid bearing in accordance with one embodiment.
Figure 12:
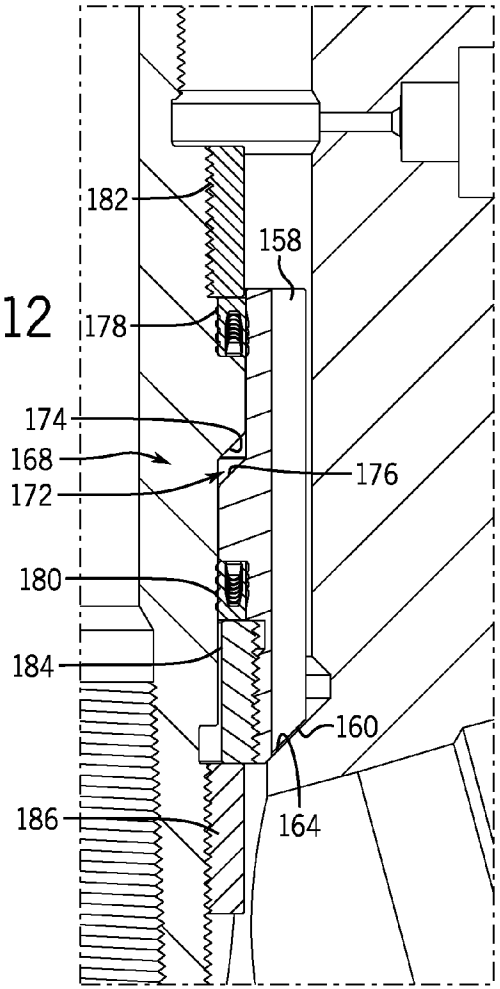
FIG. 12 is a detail view of the fluid bearing of the casing hanger assembly of FIGS. 10 and 11.
Figure 11:
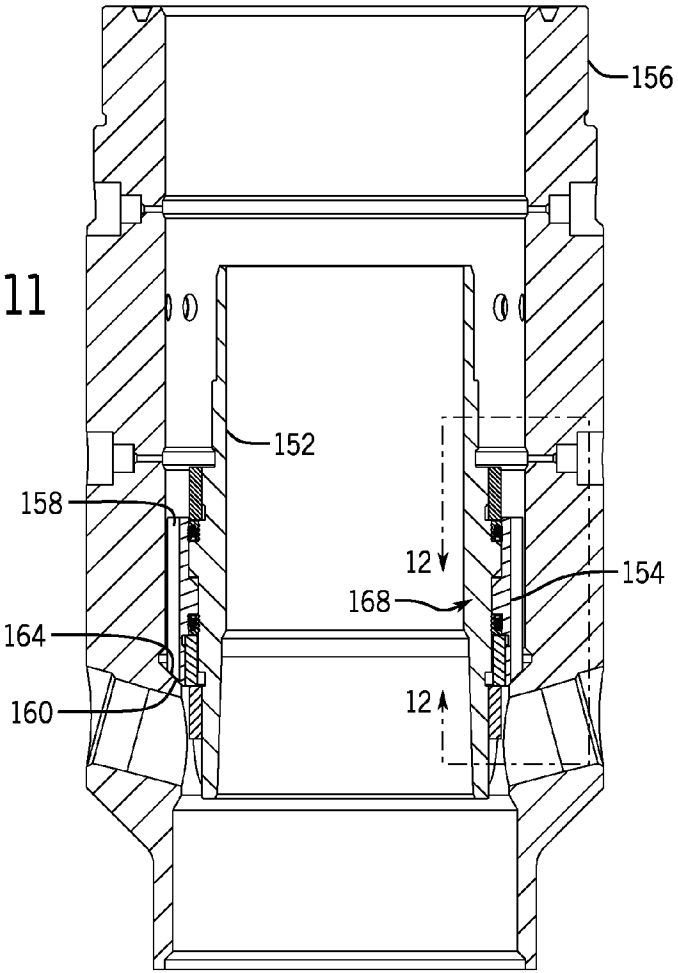
FIG. 11 is a cross-section of the casing hanger of FIG. 10 installed in a casing head in accordance with one embodiment.
Figure 13:
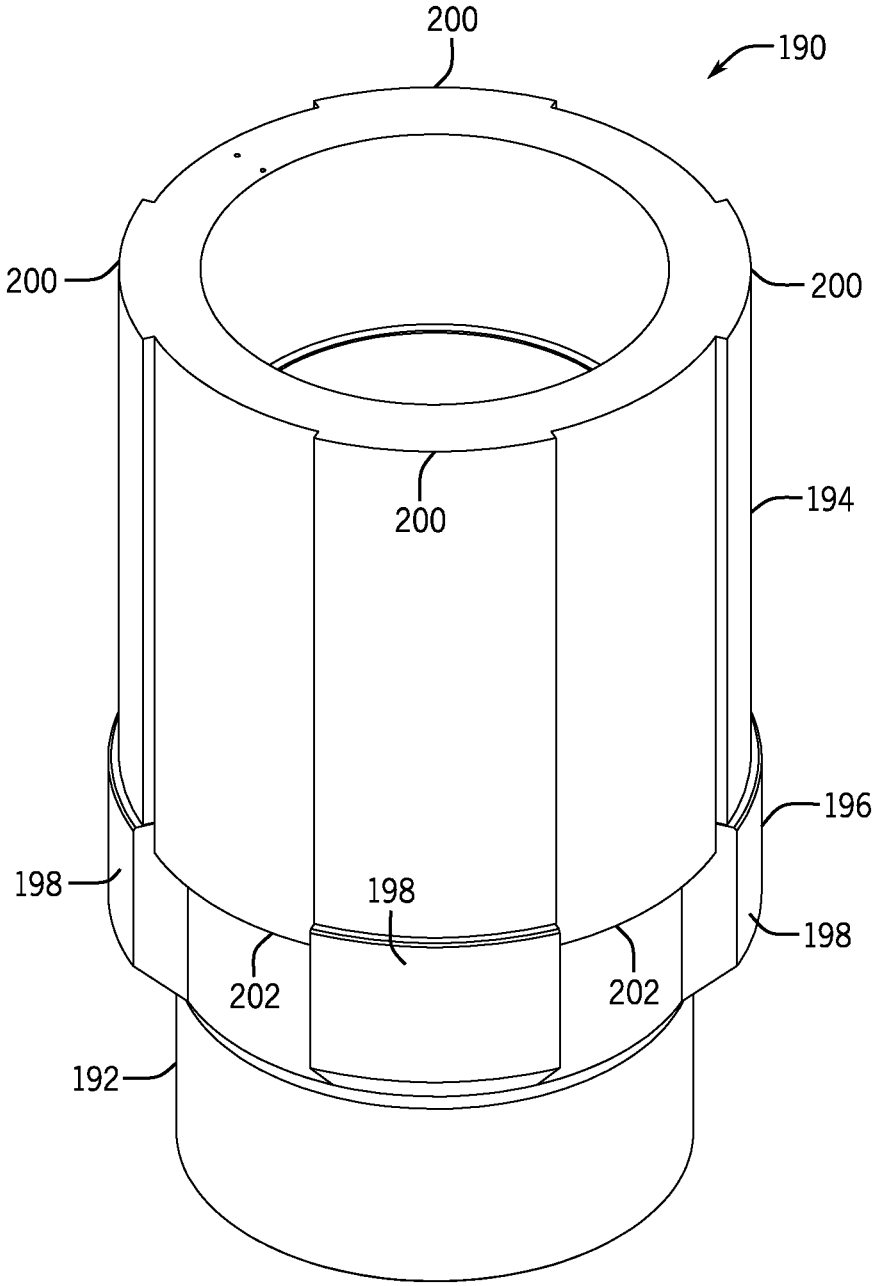
FIG. 13 is a perspective view of a casing hanger assembly having a hydraulically actuated lock ring for securing a running tool to a casing hanger in accordance with one embodiment.
Figure 14:
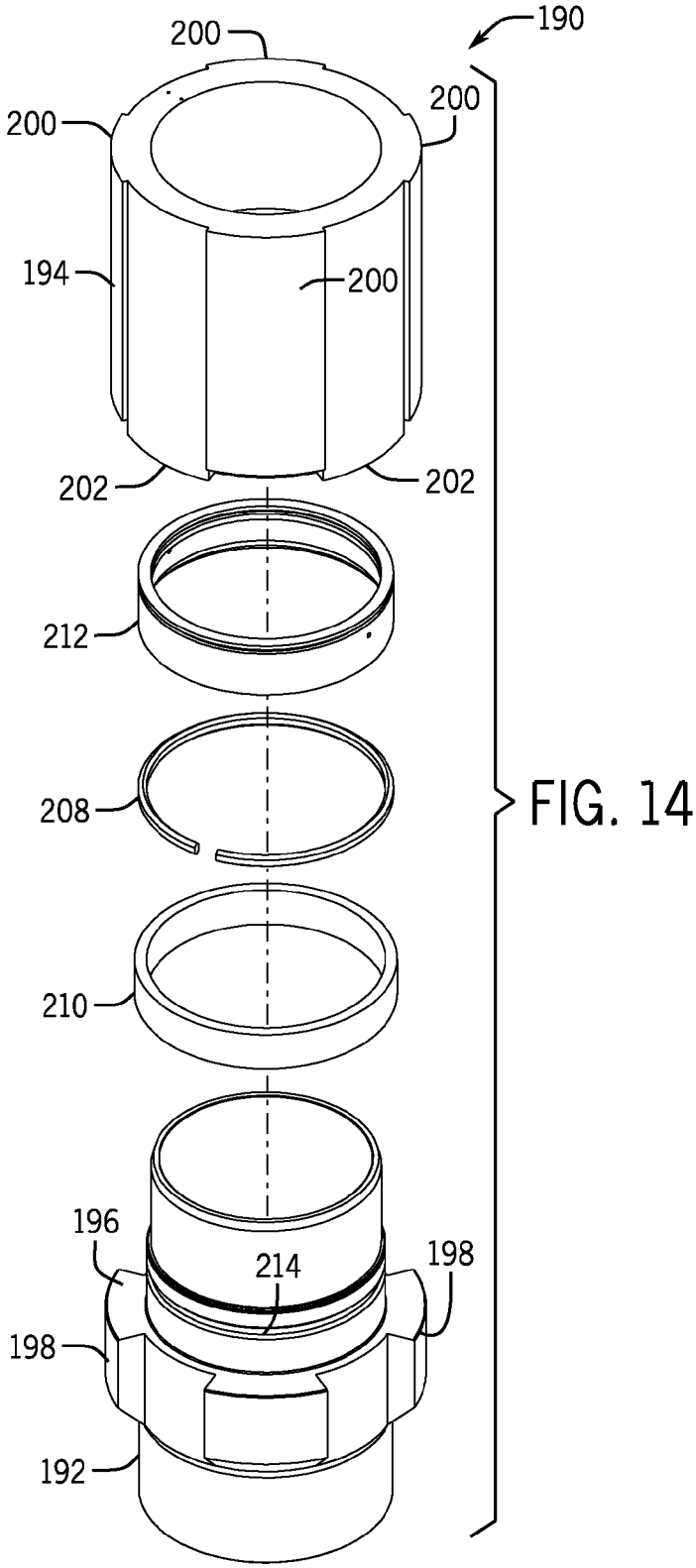
FIG. 14 is an exploded view of the casing hanger assembly of FIG. 13.

Another casing hanger assembly 150 is depicted in FIGS. 10-12 by way of example. The assembly 150 includes a mandrel casing hanger 152 and a removable landing ring 154. When installed in a casing head 156, flow-by paths or channels 158 in the landing ring 154 enable fluid to pass between the landing ring 154 and the inner wall of the casing head. The landing ring 154 includes a shoulder 160 for engaging a mating shoulder 164 of the casing head 156. It also includes a fluid port 162 for routing fluid into a fluid bearing 168 that facilitates rotation of the casing hanger 152 with respect to the casing head 156.

One example of the fluid bearing 168 is shown in greater detail in FIG. 12. In this embodiment, a pressurized cavity 172 is provided to separate a shoulder 174 of the casing hanger 152 from a mating shoulder 176 of the landing ring 154. Seals 178 and 180 inhibit leaking of pressurized fluid from the cavity 172. In one embodiment, the seals 178 and 180 are provided as stem seals that facilitate sealing engagement as the casing hanger 152 rotates with respect to the landing ring 154. Rings 182 and 184 are threaded into engagement with the seals 178 and 180 and provide an initial energizing force to the seals. Ring 186 retains the ring 184 within the landing ring 154 during rotation of the casing hanger 152.

The cavity 172 is in fluid communication with the port 162 through the landing ring 154. Fluid (e.g., grease) can be pumped into the cavity 172 to apply a preload and cause the casing hanger 152 to stand off from the landing ring 154 as generally shown in FIG. 12. Although not shown in the present figures, the casing hanger 152 can be rotated in any suitable manner, and can include external threads for connection to a running tool (e.g., the running tool 124 described above) that facilitates such rotation. During rotation of the casing hanger 152 (and any connected casing string), the fluid within the cavity 172 provides a barrier between the casing hanger 152 and the landing ring 154 and the casing hanger 152 effectively rotates on this fluid barrier to reduce friction and avoid rotating directly against the landing ring 154.

In still another embodiment, generally depicted in FIGS. 13-16, a casing hanger assembly 190 includes a mandrel casing hanger 192 and a running tool 194. The casing hanger 192 includes an integral landing ring 196 with a shoulder for engaging a mating shoulder of a casing head. The integral landing ring 196 includes castellations 198. The running tool 194 also include castellations 200 and, when these castellations 198 and 200 are aligned with one another, tabs 202 of the running tool 194 are received between the castellations 198 of the integral landing ring 196. Once assembled in this manner, torque on the running tool 194 can be transmitted to the casing hanger 192 via the engagement of the tabs 202 with the castellations 198. Though not shown in FIGS. 15 and 16, the upper end of the running tool 194 can include a threaded surface for connection to another component for driving rotation of the running tool.

Figure 16:
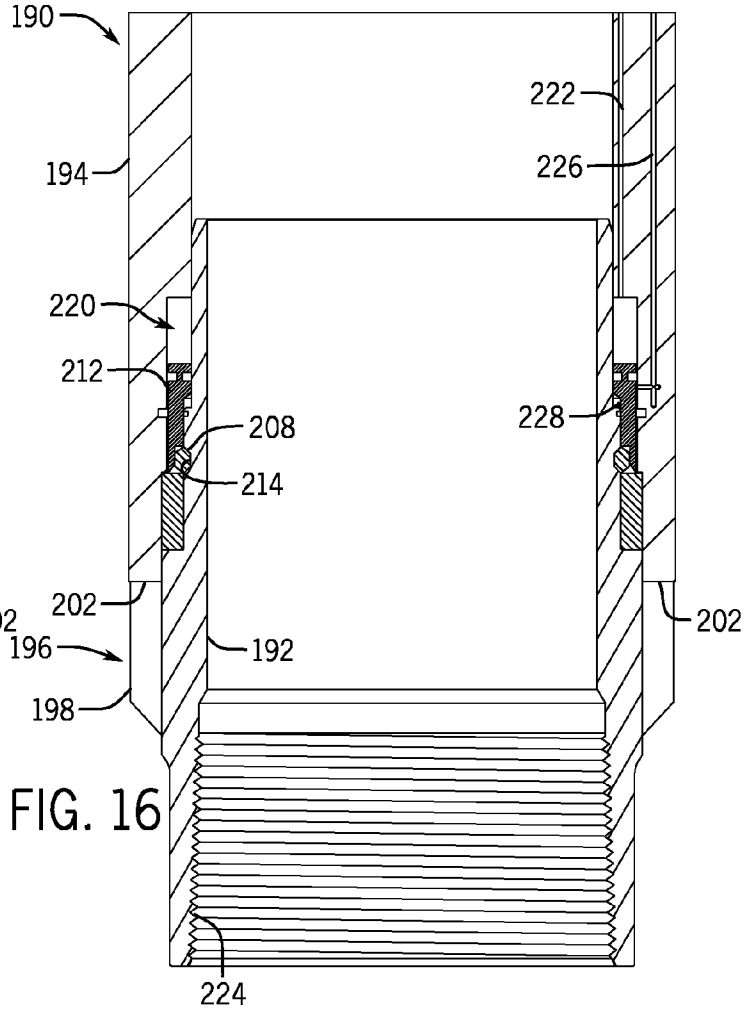
FIGS. 15 and 16 are cross-sections generally illustrating operation of the lock ring to secure the running tool to the casing hanger in accordance with one embodiment.
Figure 15:
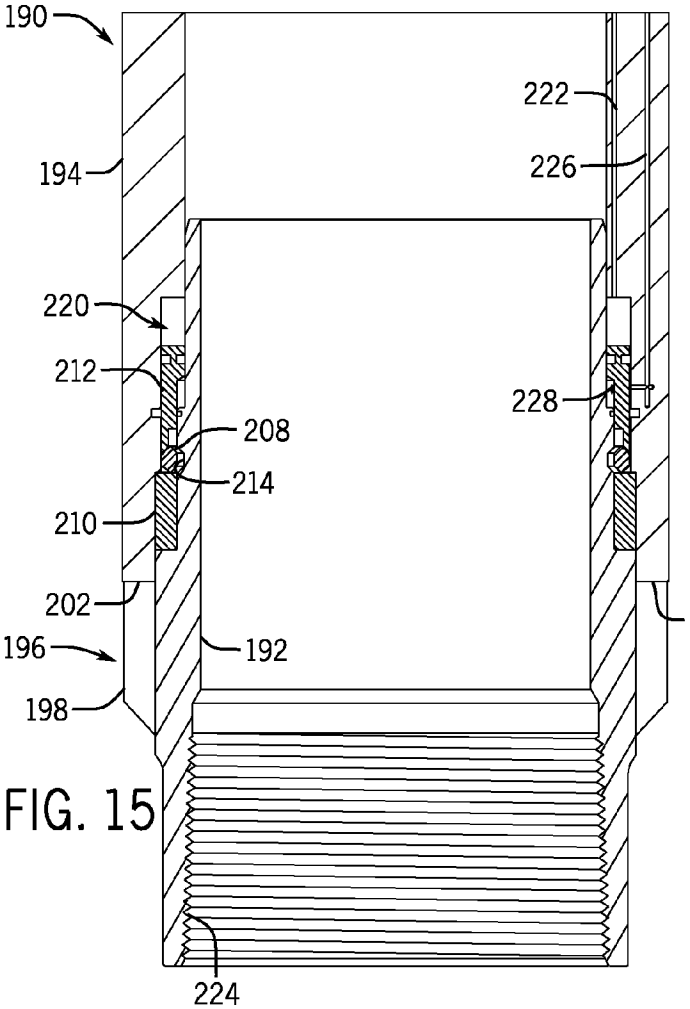

The assembly 190 also includes a lock ring 208, a spacer ring 210, and an actuator ring 212. As best seen in the cross-sections of FIGS. 15 and 16, the spacer ring 210 can be positioned about the casing hanger 192 to facilitate axial alignment of the lock ring 208 with a mating groove 214 in the casing hanger 192. The actuator ring 212 can be received within a cavity 220 between the running tool 194 and the casing hanger 192. Fluid can be pumped into the cavity 220 through the conduit 222 to move the actuator ring 212 toward the spacer ring 210, causing the lock ring 208 to be pushed radially inward into the groove 214. This locks the running tool 194 to the casing hanger 192, as generally depicted in FIG. 16. These two components can be unlocked from one another by pumping fluid into the cavity 220 through conduit 226, which drives the actuator ring 212 apart from the spacer ring 210 and allows the lock ring 208 to expand out of the groove 214. The actuator ring 212 can include one or more ports 228 that allow fluid to pass from the conduit 226 and through the actuator ring 212. As with the other embodiments, the casing hanger 192 can be connected to a casing string (e.g., via threads 224) and rotated during cementing of the casing string in a well. In this particular embodiment, once the running tool 194 is locked on the casing hanger 192, the tabs 202 engage the castellations 198 and allow rotation of the running tool 194 to be transmitted to the casing hanger 192 and any attached casing string.

Figure 17:
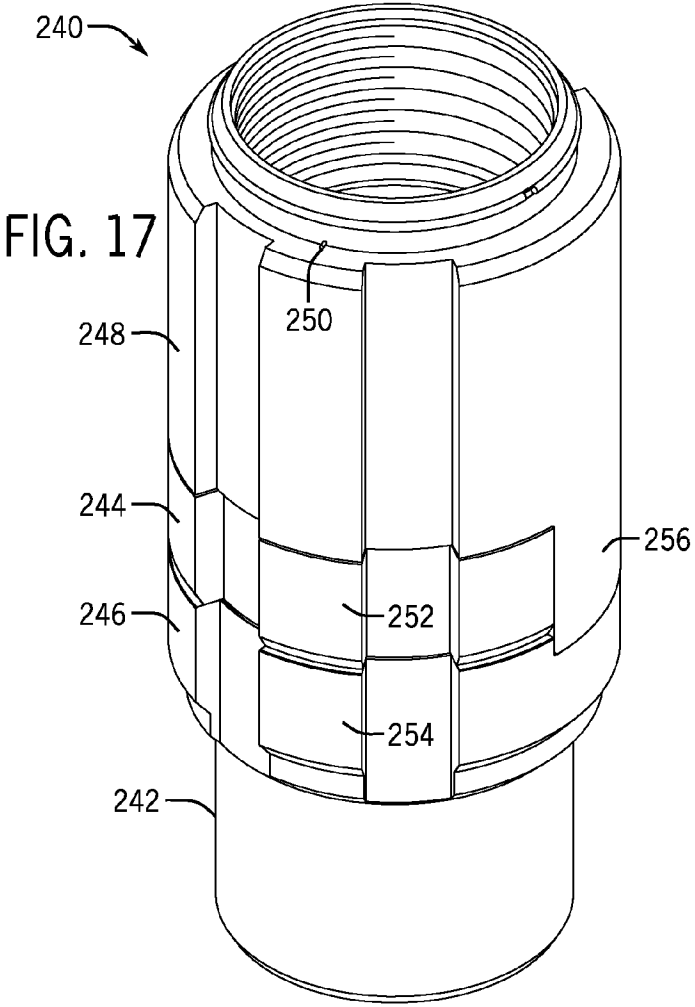
FIG. 17 is a perspective view of a casing hanger assembly having a casing hanger with a thread-down landing ring in accordance with one embodiment.

Another casing hanger assembly is depicted in FIGS. 17-20. As depicted in FIG. 17, this assembly 240 includes a mandrel casing hanger 242, a running tool 244, and a landing ring 246. The assembly 240 also includes a locking tool 248 that can be positioned about the running tool 244 and retained by one or more shear pins 250. The running tool 244 and the landing ring 246 include respective castellations 252 and 254. When the castellations 252 and 254 are aligned with one another, the locking tool 248 may be axially moved into position about the running tool 244 such that one or more castellations 256 of the locking tool 248 are inserted between the castellations 252 of the running tool 244 and engage the landing ring 246 such that the running tool 244 and the landing ring 246 rotate together via the locking tool 248.

Figure 18:
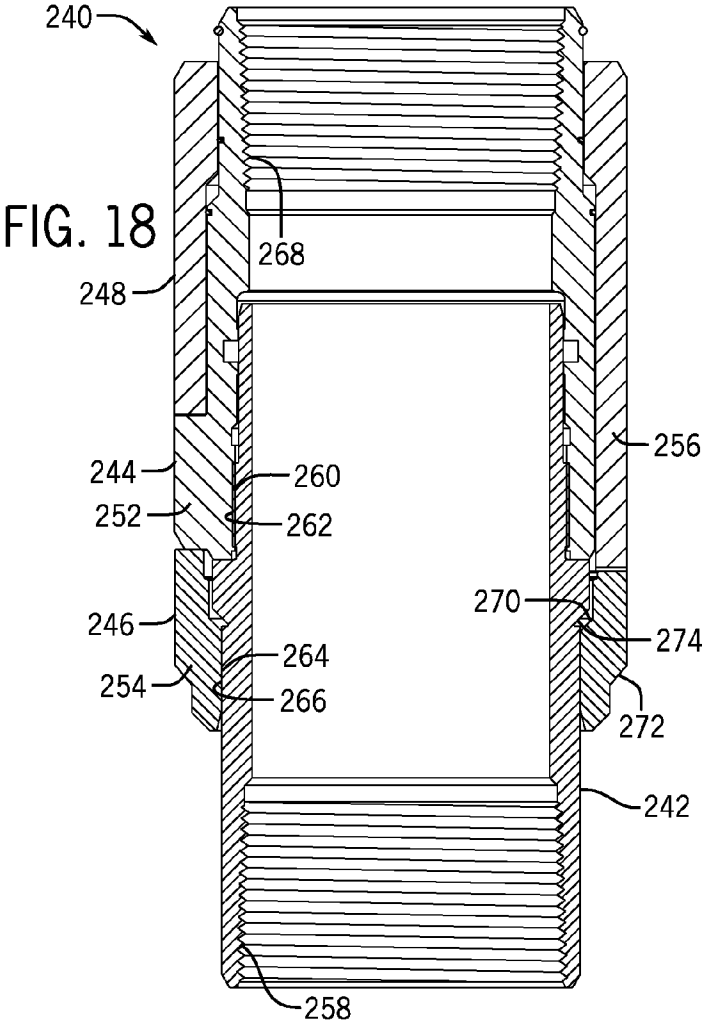
FIG. 18 is a cross-section of the casing hanger assembly of FIG. 17.

As depicted in FIG. 18, the casing hanger 242 includes an end with threads 258 for connecting to a casing string. But the casing hanger 242 also includes external threads 262 and 266 for engaging mating threads 260 and 264 of the running tool 244 and the landing ring 246. In at least one embodiment, the threads 262 and 266 are left-handed threads. During assembly, the running tool 244 can be threaded onto the casing hanger 242 via threads 260 and 262 and the landing ring 246 can be threaded onto the casing hanger 242 via threads 264 and 266. The running tool 244 and the landing ring 246 can be threaded to positions in which the castellations 252 and 254 align, allowing the castellated locking tool 248 to be installed as described above to lock the running tool 244 to the landing ring 246. This causes the running tool 244 and the landing ring 246 to rotate together. These two components can be rotated together up the casing hanger 242 to draw the landing ring 246 into an "up" position (e.g., in which an internal shoulder 270 of the landing ring 246 abuts shoulder 274 of the casing hanger 242).

Figure 20:
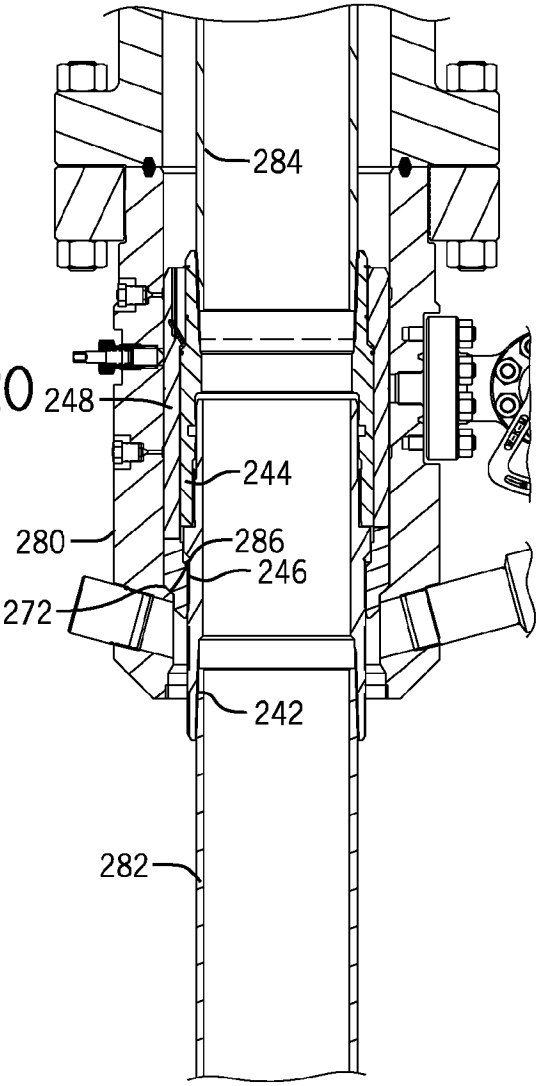
FIG. 20 generally depicts the apparatus of FIG. 19 with the landing ring having been moved down to engage the mating shoulder of the casing head in accordance with one embodiment.
Figure 19:
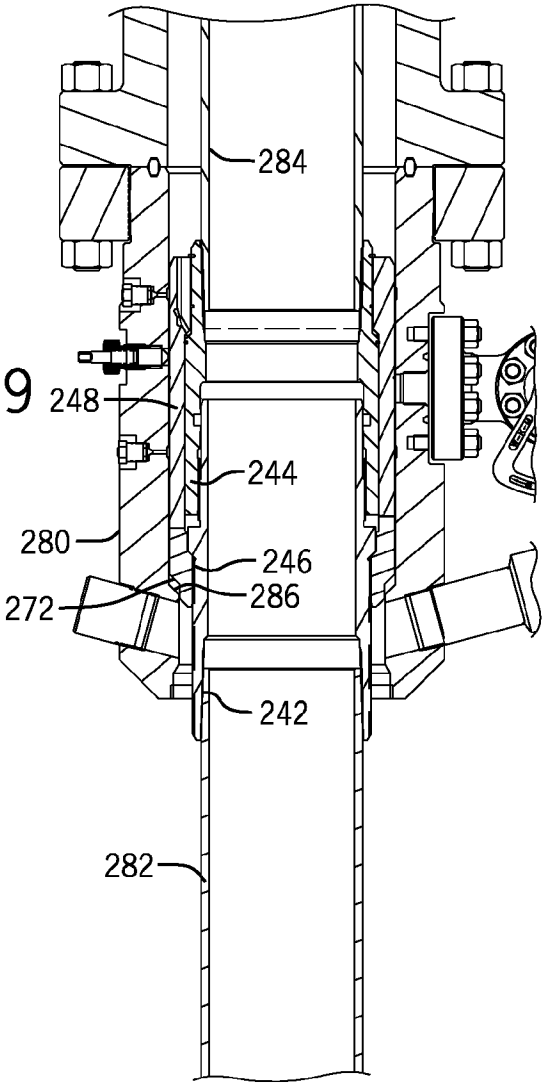
FIG. 19 generally depicts the casing hanger assembly of FIG. 17 positioned within a casing head with the landing ring moved apart from a mating shoulder of the casing head in accordance with one embodiment.

As generally depicted in FIG. 19, the assembly 240 may then be run down into a casing head 280 and connected to a casing string 282 with an external shoulder 272 of the landing ring 246 spaced apart from a shoulder 286 of the casing head 280. The casing hanger 242, the running tool 244, the landing ring 246, and the casing string 282 can be synchronously rotated (e.g., to the right) while cementing the casing string 282 within the well. Such rotation can be effected in any suitable way, such as by rotation of a casing 284 or some other tool connected to the running tool 244 via threads 268 (FIG. 18). In embodiments in which the threads 262 and 266 are provided in an opposite direction from the threads 258 and 268 (e.g., left-handed for the former and right-handed for the latter), such an arrangement retains the separation of the shoulder 272 of the landing ring 246 from the shoulder 286 of the casing head 280 during rotation of the assembly 240 and cementing of the casing. Once the cementing has been completed, however, the running tool 244 can be rotated in the opposite direction (e.g., to the left) to cause the running tool 244 and the landing ring 246 to axially translate down the casing hanger 242 and to cause the shoulder 272 of the landing ring 246 to engage the shoulder 286 of the casing head 280, as generally depicted in FIG. 20. The locking tool 248 can then be retracted from the landing ring 246 (e.g., using hydraulics) to unlock the running tool 244 from the landing ring 246, allowing the running tool 244 to then be unthreaded from the casing hanger 242 and removed from the casing head 280.

Figure 21:
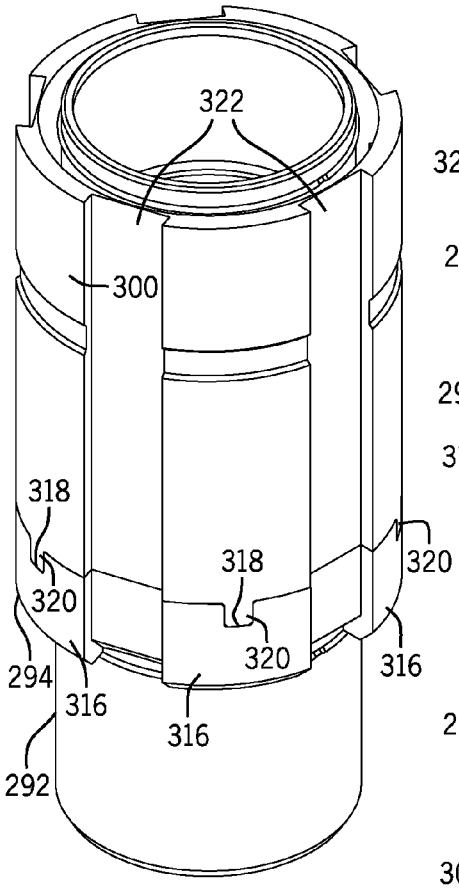
FIG. 21 is a perspective view of a casing hanger assembly with a castellated running tool and gall-resistant rings in accordance with one embodiment.
Figure 22:
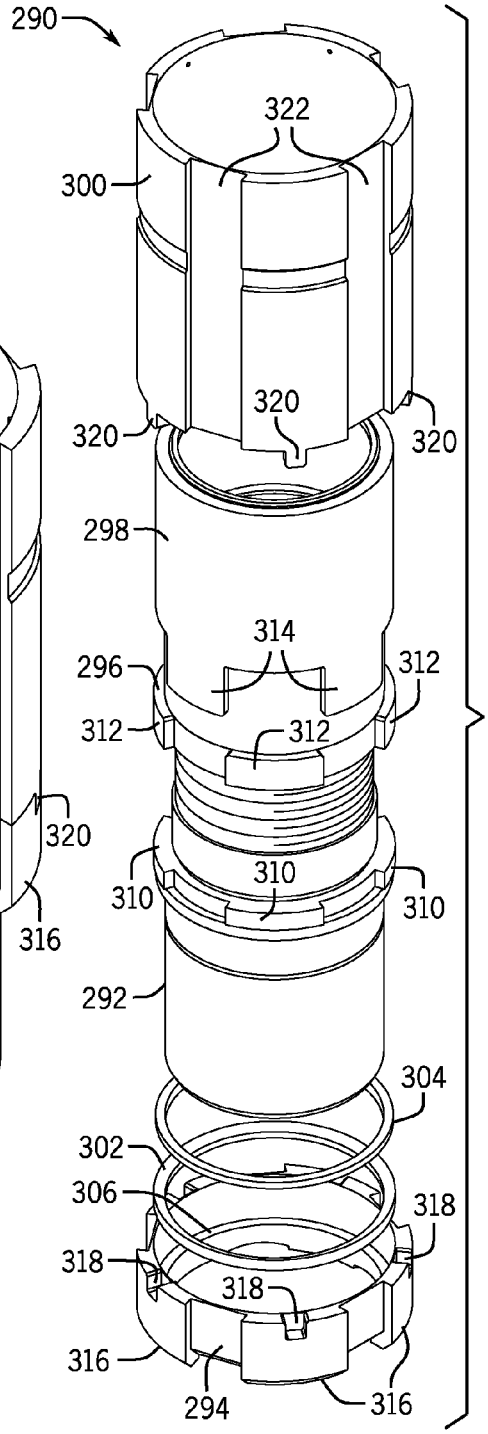
FIG. 22 is an exploded view of the casing hanger assembly of FIG. 21.

Another casing head assembly 290 is depicted in FIGS. 21-24 in accordance with one embodiment. This assembly 290 includes a mandrel casing hanger 292, a landing ring 294, a running tool 296, a locking tool 298, and a wear sleeve 300. As best seen in FIG. 22, the landing ring 294 includes an aperture for receiving the casing hanger 292. In the depicted embodiment, the assembly 290 also includes two gall-resistant rings 302 and 304, though a different number of gall-resistant rings could be used in other embodiments. The gall-resistant ring 302 can be landed on an internal shoulder 306 of the landing ring 294, followed by the gall-resistant ring 304. The casing hanger 292 includes castellations 310, and the running tool 296 similarly includes castellations 312. The running tool 296 can be connected to the casing hanger 292 (e.g., via a threaded connection), and the castellations 310 and 312 can be aligned to allow castellations 314 of the locking tool 298 to be received between the castellations 310 and between the castellations 312. This serves to lock the running tool 296 to the casing hanger 292 so that these two components can be rotated synchronously (e.g., rotation of the running tool 296 is transmitted to the casing hanger 292 via the castellations 314 of the locking tool 298).

The landing ring 294 also includes castellations 316, which generally define flow-by channels between the castellations 316. As depicted in FIGS. 21 and 22, the castellations 316 include recesses 318 for receiving tabs 320 of the wear sleeve 300. When the tabs 320 are positioned within the recesses 318, flow-by channels 322 of the wear sleeve are aligned with those of the landing ring 294.

Figure 23:
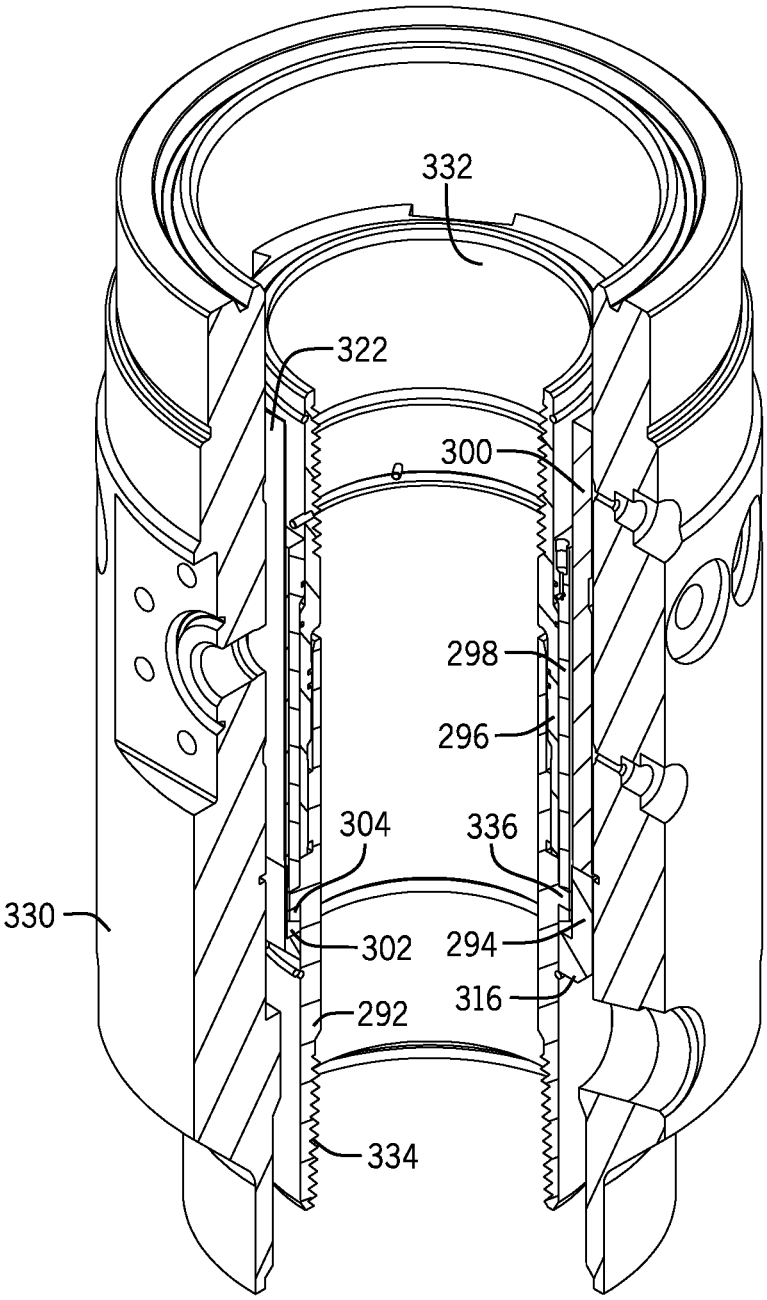
FIG. 23 is a section view of the assembled casing hanger assembly of FIG. 21 installed in a casing head in accordance with one embodiment.
Figure 24:
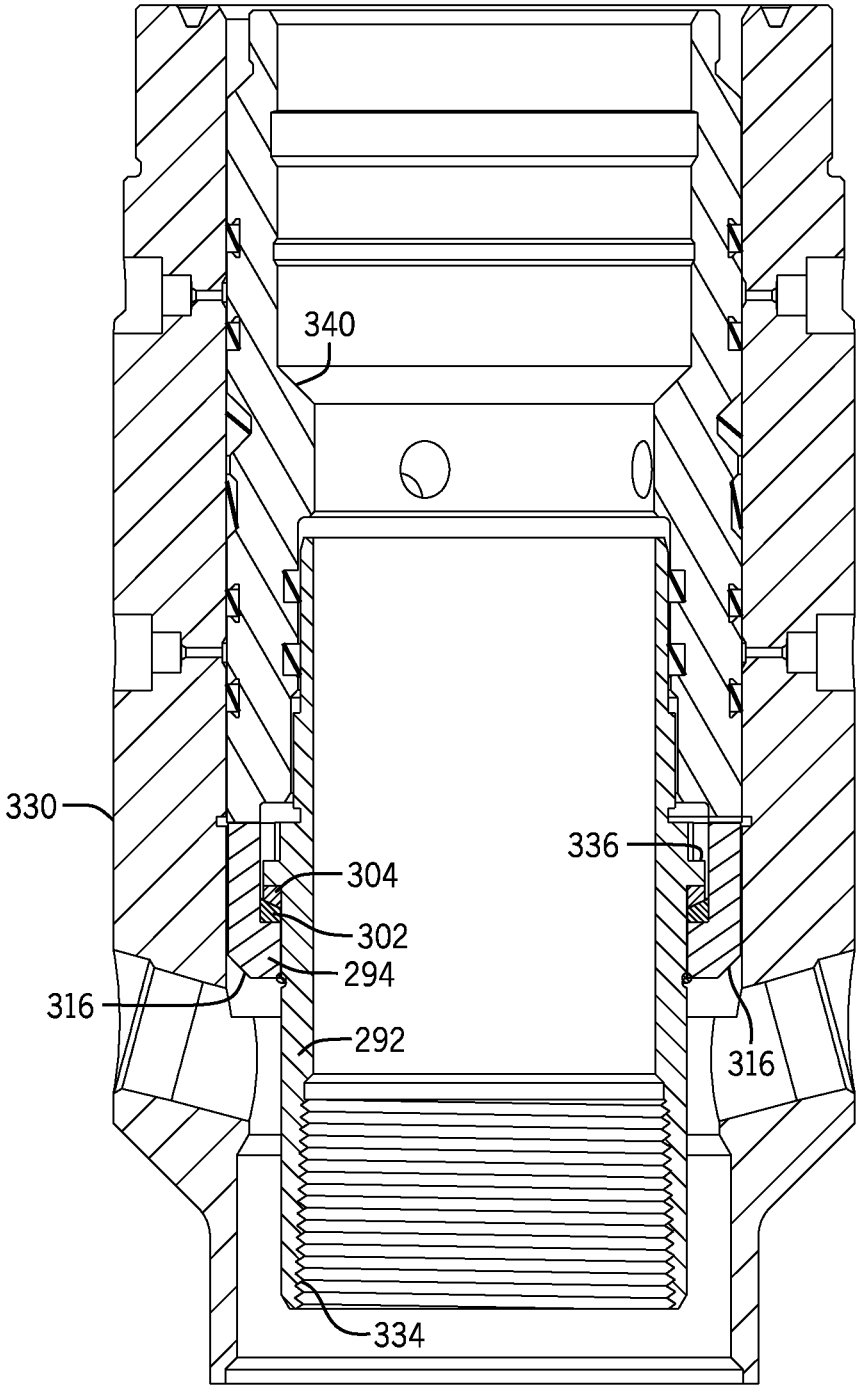
FIG. 24 is a cross-section generally depicting installation of a packoff within the casing head of FIG. 23 in accordance with one embodiment.

With reference now to FIG. 23, which depicts the assembly 290 installed in a casing head 330, the running tool 296 includes a threaded end 332 for connection with a casing or tool to drive rotation of the running tool 296. Because the running tool 296 is locked to the casing hanger 292 by the locking tool 298, the casing hanger 292 (and any casing attached to the casing hanger via threaded end 334) rotates synchronously with the running tool 296. Thus, like the other embodiments described above, the casing hanger 292 can be rotated during cementing of the casing. As also shown in this figure, the casing hanger 292 includes a flange 336 that is landed on the gall-resistant ring 304. The one or more gall-resistant rings (e.g., rings 302 and 304) facilitate rotation of the casing hanger 292 with respect to the landing ring 294 while inhibiting galling of the flange 336 or the shoulder 306. Thus, the casing hanger 292 can be rotated "on-shoulder" during cementing of the casing (in that the casing hanger 292 loads downward on the landing ring 294 via the gall-resistant rings), rather than being rotated "off-shoulder" (in which the casing hanger 292 would be lifted up with respect to the landing ring 294). As generally depicted in FIG. 24, the running tool 296, the locking tool 298, and the wear sleeve 300 can be removed from the assembly 290 to allow a packoff 340 to be installed within the casing head 330.

Figure 25:
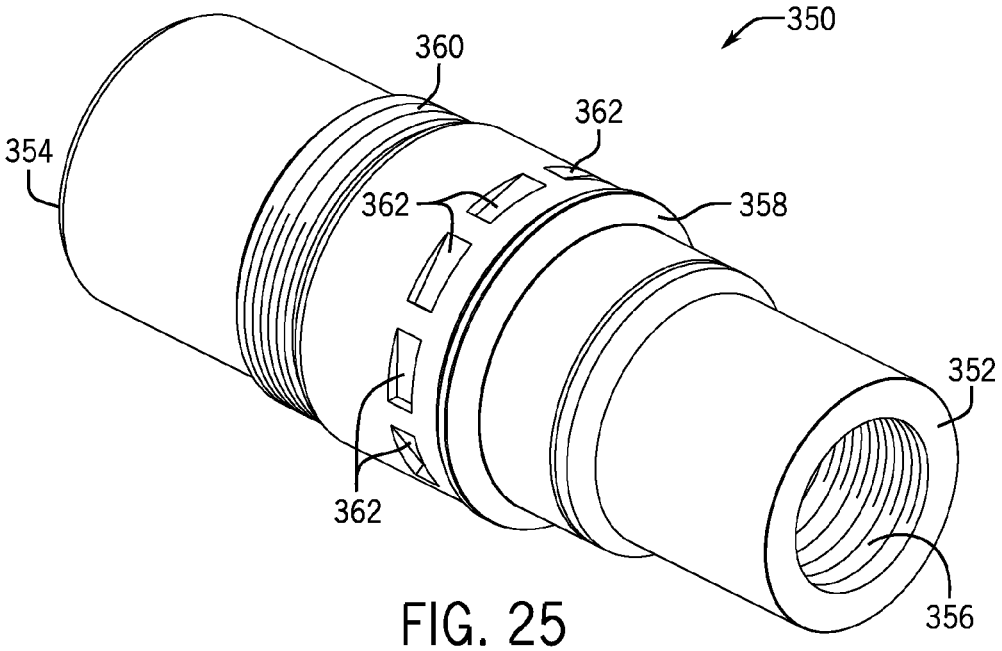
FIG. 25 is a perspective view of a casing hanger having angled recesses formed about its circumference in accordance with one embodiment.
Figure 26:
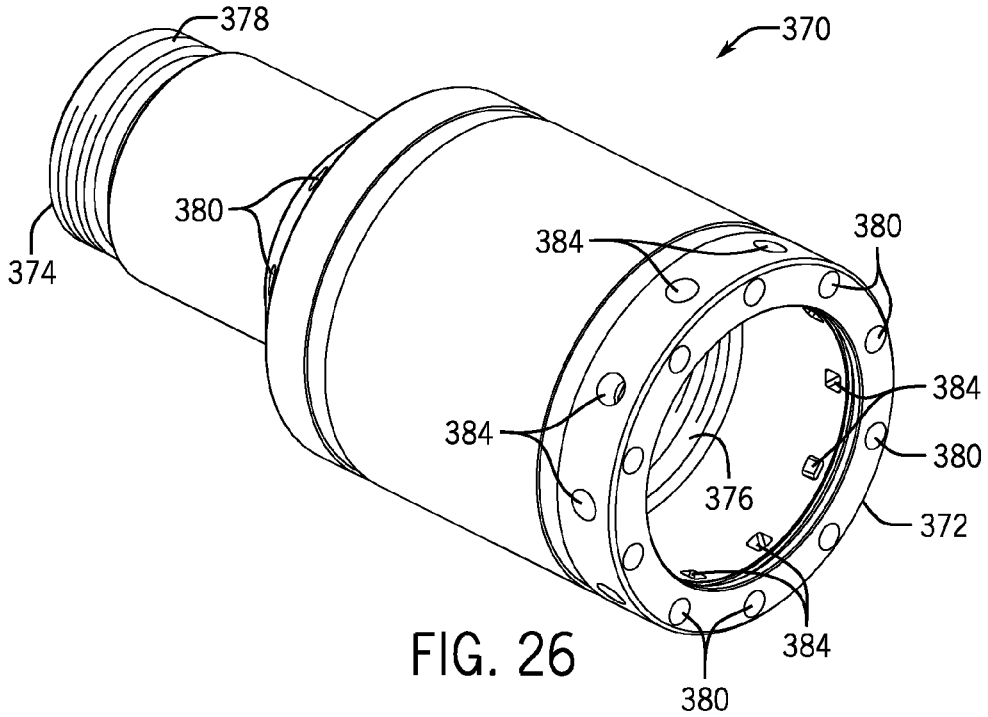
FIG. 26 is a perspective view of a running tool for use with the casing hanger of FIG. 25, the running tool having radial apertures for locking pins to engage the angled recesses of the casing hanger in accordance with one embodiment.

One more embodiment of a casing hanger assembly is generally depicted in FIGS. 25-31. Specifically, a mandrel casing hanger 350 is depicted in FIG. 25 and a mating running tool 370 is depicted in FIG. 26. The casing hanger 350 includes a lower end 352 with internal threads 356 for connecting the casing hanger 350 to a casing string and an upper end 354 that can be received by the running tool 370. The casing hanger 350 also includes a shoulder 358 for landing the casing hanger 350 within a landing ring 392 (FIG. 27) and an external threaded surface 360 for receiving the running tool 370. Still further, the casing hanger 350 includes recesses 362 that facilitate locking engagement of the running tool 370 with the casing hanger 350, as described in greater detail below. The recesses 362 are presently depicted as being arrayed circumferentially about the casing hanger 350 at the same axial distance along the hanger, though other arrangements could be used instead.

The running tool 370 includes a lower end 372 for receiving the casing hanger 350 and an upper end 374 for connection to a component for transmitting torque to the running tool 370 (which can then be transmitted to the casing hanger 350 and a connected casing string). The running tool 370 can be threaded onto the external threaded surface 360 of the casing hanger 350 via internal threaded surface 376, and threads 378 allow connection of the running tool 370 so that it may be driven by another component. The running tool 370 also includes through holes 380 that allow fluid to flow though the running tool 370 when positioned in a casing head. Additionally, the running tool 370 includes apertures or holes 384 that extend from an outer surface of the running tool to an inner surface. In some embodiments, like that shown in FIG. 26, the holes 384 extend radially through the running tool 370. As described in more detail below, the holes 384 are positioned on the running tool 370 so that they can be aligned with the recesses 362 of the casing hanger 350 as the running tool 370 is threaded onto the casing hanger 350.

Figure 27:
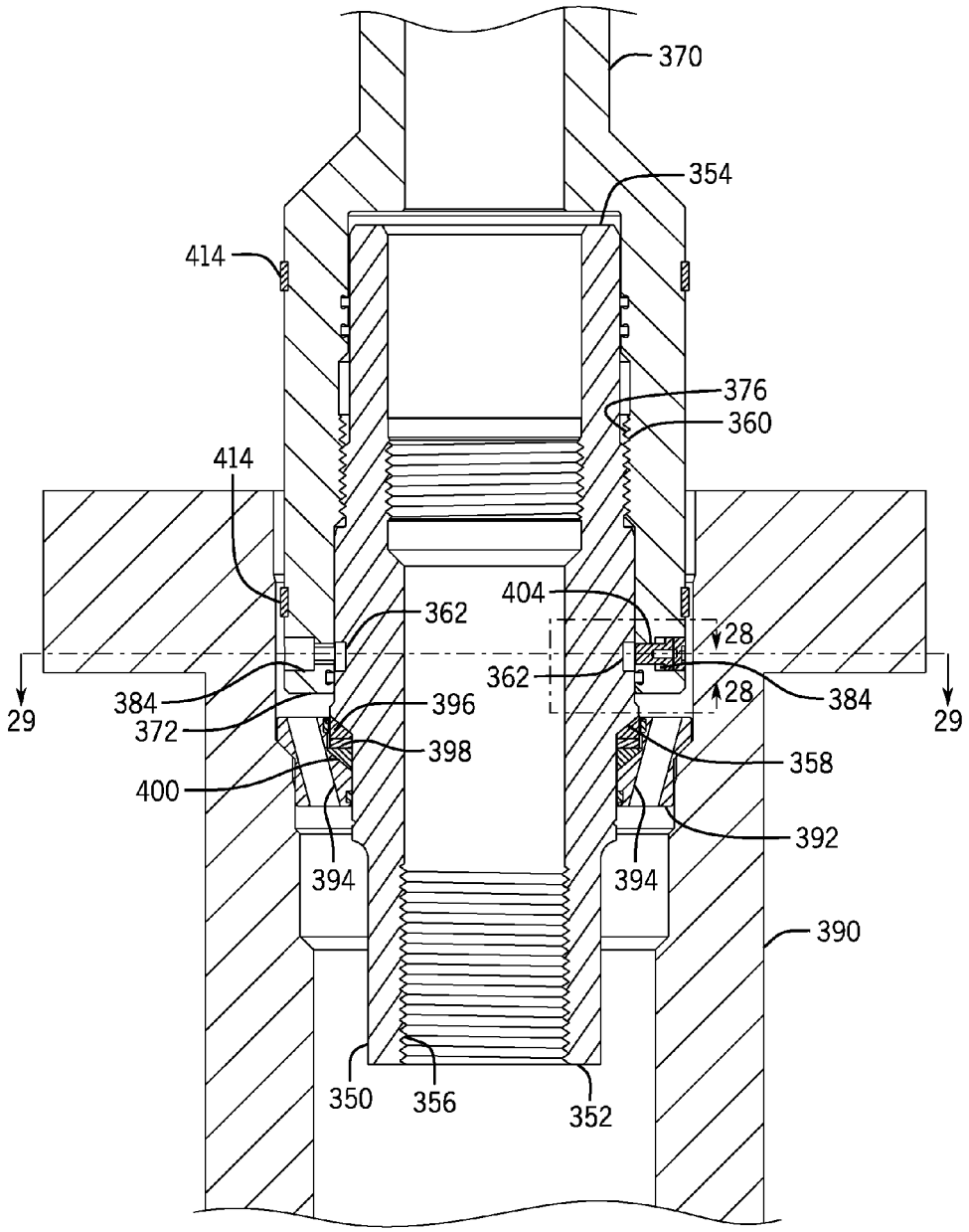
FIG. 27 is cross-section of the casing hanger and the running tool of FIGS. 25 and 26 shown installed within a casing head in accordance with one embodiment.

In FIG. 27, the casing hanger 350 is shown as connected to the running tool 370 and installed within a casing head 390. The casing hanger 350 is received within a landing ring 392 (which may also be referred to as a landing collar) that has an external shoulder that engages an internal shoulder of the casing head 390. The landing ring 392 has flow-by ports 394 that allow the passage of fluid. Additionally, one or more gall-resistant rings can be provided between the landing ring 392 and the casing hanger 350. In the presently depicted embodiment, three gall-resistant rings 396, 398, and 400 are so provided. But other embodiments could have a different number of such rings (including embodiments that omit such rings entirely). The running tool 370 is also depicted in FIG. 27 as including wear bearings 414 about its exterior.

Figure 28:
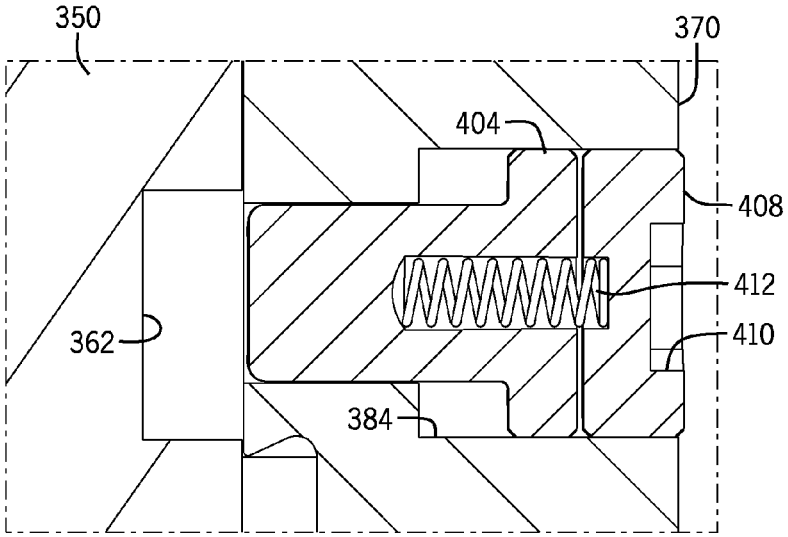
FIG. 28 is a detail view of a locking pin that can be installed within a radial aperture of the running tool and aligned with an angled recess of the casing hanger in accordance with one embodiment.

Locking pins 404 are also provided in some or all of the holes 384 in the running tool 370, and one example of such a locking pin 404 is depicted in FIG. 28. In this example, the locking pin 404 is enclosed in a hole 384 with a cap 408. The cap 408 can be threaded into the hole 384 or retained in any other suitable manner. The depicted cap 408 includes a tool recess 410 to facilitate installation and removal of the cap 408 from the hole 384. In this embodiment, the locking pin 404 is spring-loaded in that a spring 412 is provided between the cap 408 and the locking pin 404 so as to provide a biasing force (directed radially inward) to the pin 404.

Figure 29:
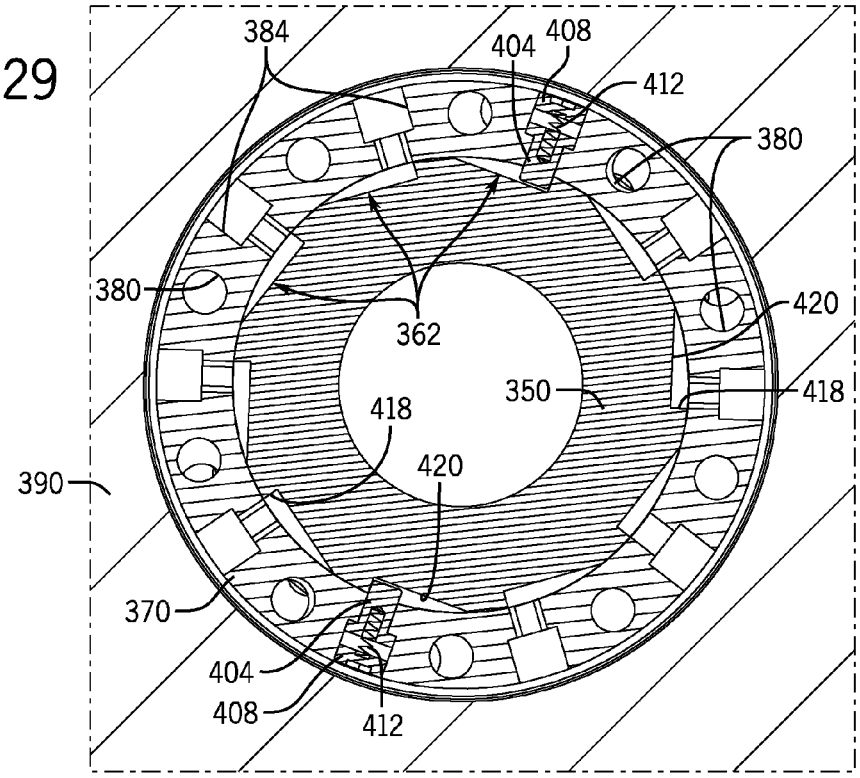
FIG. 29 is an axial cross-section of the casing hanger and the running tool in FIG. 27.

The running tool 370 translates axially along the casing hanger 350 as it is threaded onto the casing hanger 350 via threaded surfaces 360 and 376. The locking pins 404 are biased inwardly by springs 412 into engagement with the outer surface of the casing hanger 350 as the running tool 370 is first rotated along the threaded surface 360 until the axial translation of the running tool 370 brings the holes 384 (with the locking pins 404) into alignment with the recesses 362. Upon such alignment, however, the locking pins 404 extend inwardly into the recesses 362 due to the bias applied by the springs 412, as generally depicted in FIG. 29. While only two pins 404 are depicted in FIG. 29 for the sake of clarity, it will be appreciated that in at least some embodiments a locking pin 404 is provided in each of the holes 384 for engaging a mating recess 362. But in other embodiments, fewer than all of the holes 384 include a locking pin 404. And while the depicted embodiment includes ten recesses 362 and ten holes 384, other embodiments can differ from such a configuration.

Each recess 362 in FIG. 29 is shown as having an angled profile with a stop surface or shoulder 418 and an angled (return) surface 420. In at least some embodiments, such as that depicted here, the stop surfaces are radial stop surfaces that are formed orthogonal to the outer circumference of the casing hanger 350. In the present embodiment, the running tool 370 is rotated clockwise (via right-handed threads on surfaces 360 and 376) down onto the casing hanger 350 until the locking pins 404 are aligned with the recesses 362.

When aligned in this manner, the locking pins 404 are pushed into the recesses 362 by the springs 412 and engagement of the pins 404 with the stop surfaces 418 inhibits further rotation of the running tool 370 about the casing hanger 350 in the clockwise direction. Rather, once the locking pins 404 extend into the recesses 362, further rotation of the running tool 370 in the clockwise direction causes synchronous movement of the casing hanger 350 in the clockwise direction. That is, the locking pins 404 transmit torque on the running tool 370 to the casing hanger 350 via the stop surfaces 418. Through this engagement, the running tool 370 can rotate the casing hanger 350 and an attached casing string, such as during cementing of the casing string. Using the locking pins 404 in this way prevents the running tool 370 from being excessively tightened onto the casing hanger 350 via the threaded surfaces 360 and 376, and allows rotation of the casing hanger 350 by the running tool 370 without transmitting torque directly through the threads of surfaces 360 and 376 (which could cause the threads to stick and prevent removal of the running tool 370 from the casing hanger 350). It also permits easy removal of the running tool 370 from the casing hanger 350, such as after cementing the casing. Particularly, the running tool 370 can be threaded off the casing hanger 350 (e.g., by rotating it counterclockwise in the present embodiment). The angled surfaces 420 push the locking pins 404 against the springs 412 and back into the holes 384, allowing the running tool 370 to rotate freely off of the casing hanger 350.

Figure 30:
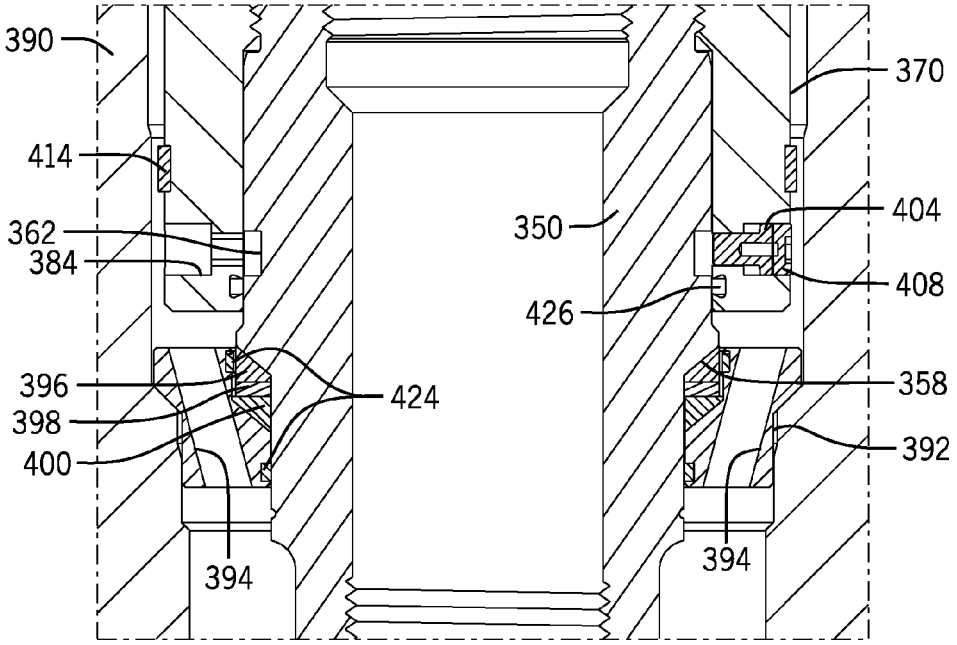
FIG. 30 is a detail view of a landing ring depicted in FIG. 27, the landing ring having several gall-resistant rings to facilitate rotation of the casing hanger with respect to the landing ring in accordance with one embodiment.
Figure 31:
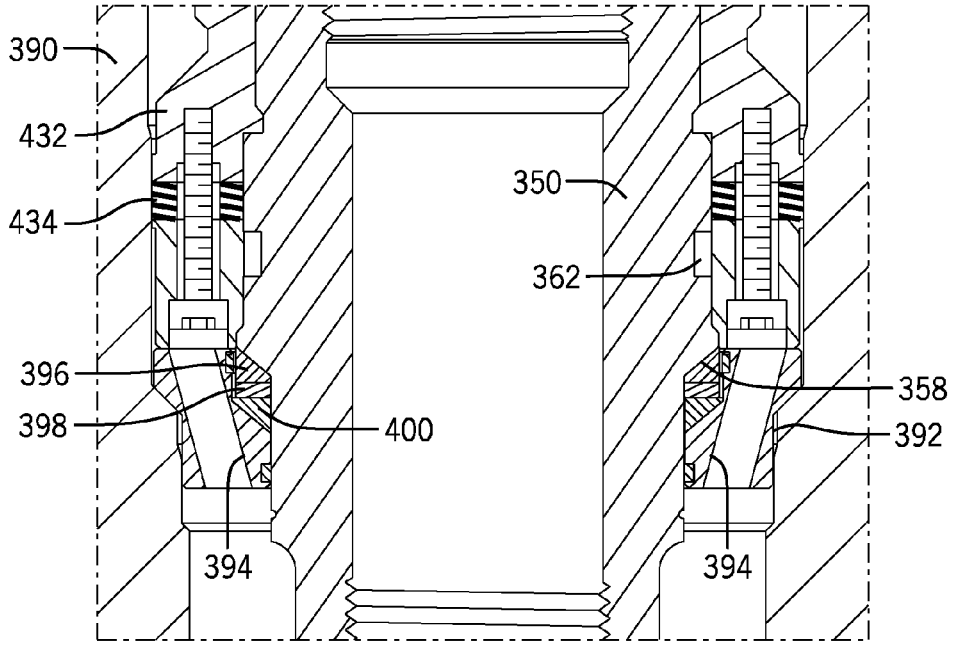
FIG. 31 is a detail view generally depicting a packoff installed in the casing head after removal of the running tool from the casing hanger in accordance with one embodiment.

Additional details of the rotation of the casing hanger 350 with respect to the landing ring 392 may be better appreciated with reference to FIG. 30. In this illustration, the landing ring includes strips 424 that reduce friction between rotating components (here the casing hanger 350, the landing ring 392, and the gall-resistant ring 396) and a wiper seal 426 to inhibit entry of fluid (e.g., cement) into the recesses 362 or holes 384. As noted above, the present embodiment includes three gall-resistant rings 396, 398, and 400. Such gall-resistant rings can be made from any suitable material, such as nitrided chromoly steel. As depicted, the ring 396 has a tapered upper edge that engages the shoulder 358 of the casing hanger 350, and the ring 400 includes a tapered lower edge that engages a mating shoulder of the landing ring 392. The ring 398 in the present embodiment is provided with two parallel surfaces for engaging mating surfaces of the rings 396 and 400. Again, the inclusion of one or more gall-resistant rings reduces wear on the casing hanger 350 and the landing ring 392, while allowing the landing ring 392 to support some or all of the load from the casing hanger (and attached casing) during rotation of the casing while cementing. Of course, the casing hanger 350 could instead be lifted off of the landing ring 392 such that the full load of the casing hanger 350 and the casing is supported in some other way (e.g., by a top drive). Once the casing is cemented into place, the running tool 370 can be removed from the casing hanger 350 and a packoff 432 with a rubber sealing component 434 can be installed in the casing head 390, as generally depicted in FIG. 31.

Each of the casing hanger assemblies described above can be used to rotate a casing string during cementing of the casing string within a well. It will be appreciated that each of the embodiments described above are configured in some manner to facilitate rotation of a casing hanger and a casing string, such as during cementing of the casing string. The various running tools described herein can be used to transmit torque to the casing hangers, causing the casing hangers and attached casing strings to rotate synchronously. Once rotation is completed (e.g., after cementing of the casing strings), the running tools can be removed from the casing hangers.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system comprising:

a casing hanger having external threads and external recesses positioned radially about an outer surface of the casing hanger; and a running tool having internal threads for engaging the external threads of the casing hanger, the running tool further including locking pins positioned within radial holes in the running tool and arranged to engage the external recesses and enable torque on the running tool to be applied to the casing hanger for synchronous rotation via engagement of the locking pins with the external recesses when the running tool is threaded onto the casing hanger, wherein the running tool and locking pins are further arranged to enable the locking pins to extend from the running tool into contact with the casing hanger as the running tool is threaded onto the casing hanger, and the system does not rely on a retention mechanism that prevents the locking pins from extending from the running tool into contact with the casing hanger as the running tool is threaded onto the casing hanger, such that, during threading of the running tool onto the casing hanger, the locking pins rotate about and in contact with the casing hanger as the running tool translates axially along the casing hanger and the locking pins automatically extend inwardly into the external recesses of the casing hanger when the axial translation of the running tool along the casing hanger brings the radial holes in which the locking pins are positioned into alignment with the external recesses.

2. The system of claim 1, wherein the locking pins include spring-loaded locking pins.

3. The system of claim 2, wherein the external recesses comprise:

stop surfaces configured to bear against the locking pins during synchronous rotation of the running tool and the casing hanger when the running tool is rotated in a first direction; and angled surfaces configured to bias the spring-loaded locking pins out of the external recesses when the running tool is rotated in a second direction opposite the first direction.

4. The system of claim 1, comprising a landing collar configured to receive the casing hanger.

5. The system of claim 4, comprising a plurality of gall-resistant rings disposed between the landing collar and the casing hanger.

6. The system of claim 5, comprising a casing head, wherein the landing collar is landed on a shoulder of the casing head and the gall-resistant rings facilitate rotation of the casing hanger inside the casing head with respect to the landing collar.

7. A system comprising:

a casing hanger having a lower end configured to engage a casing string; and a running tool configured to engage the casing hanger;

wherein the system is configured to facilitate rotation of the casing hanger within a casing head to rotate the casing string while cementing the casing string within a well, the casing hanger and the running tool include mating threaded surfaces, the casing hanger includes external recesses facing radially outward from the casing hanger, and the running tool includes spring-loaded locking pins positioned to move circumferentially about and in contact with the casing hanger during rotation of the running tool onto the casing hanger along the mating threaded surfaces and to automatically engage the external recesses once rotation of the running tool onto the casing hanger along the mating threaded surfaces brings the spring-loaded locking pins into alignment with the external recesses of the casing hanger.

8. The system of claim 7, comprising a landing ring and at least one gall-resistant ring to facilitate rotation of the casing hanger with respect to the landing ring.

9. The system of claim 7, comprising the casing string.

10. A method comprising:

coupling a running tool to a mandrel casing hanger, wherein coupling the running tool to the mandrel casing hanger includes threading the running tool onto the mandrel casing hanger, and threading the running tool onto the mandrel casing hanger includes:

rotating the running tool in a first direction with respect to the mandrel casing hanger to thread the running tool and the mandrel casing hanger together while spring-loaded locking pins in the running tool extend inwardly into engagement with an exterior surface of the mandrel casing hanger; and continuing to rotate the running tool in the first direction with the spring-loaded locking pins in engagement with the exterior surface of the mandrel casing hanger until the spring-loaded locking pins in the running tool are axially and radially aligned with radially positioned recesses formed in the exterior surface of the mandrel casing hanger, at which time the spring-loaded locking pins automatically extend further inward into the radially positioned recesses formed in the exterior surface of the mandrel casing hanger;

coupling the mandrel casing hanger to a casing string; and rotating the casing string within a well in the first direction via the mandrel casing hanger, wherein rotating the casing string within the well in the first direction via the mandrel casing hanger includes rotating the running tool in the first direction to transmit torque from the running tool to the mandrel casing hanger via the spring-loaded locking pins and cause rotation of the casing string within the well.

11. The method of claim 10, wherein rotating the casing string within the well in the first direction via the mandrel casing hanger includes rotating the casing string within the well in the first direction via the mandrel casing hanger during cementing of the casing string within the well.

12. The method of claim 10, comprising rotating the running tool in a second direction, opposite the first direction, to cause the spring-loaded locking pins to retract and to detach the running tool from the mandrel casing hanger.

* * * * *